US009490545B2

(12) United States Patent
Montgomery

(10) Patent No.: US 9,490,545 B2
(45) Date of Patent: Nov. 8, 2016

(54) FREQUENCY SELECTIVE POLARIZER

(71) Applicant: Honeywell International Inc., Morristown, NJ (US)

(72) Inventor: James Patrick Montgomery, Marietta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 650 days.

(21) Appl. No.: 13/939,259

(22) Filed: Jul. 11, 2013

(65) Prior Publication Data

US 2015/0015440 A1 Jan. 15, 2015

(51) Int. Cl.

| | |
|---|---|
| ***H01Q 21/06*** | (2006.01) |
| ***H01Q 15/24*** | (2006.01) |
| ***H01P 1/17*** | (2006.01) |

(52) U.S. Cl.

CPC ..... *H01Q 15/248* (2013.01); *H01P 1/17* (2013.01); *H01Q 15/244* (2013.01)

(58) Field of Classification Search

CPC .... H01Q 21/06; H01Q 21/24; H01Q 15/248; H01Q 15/224; H04B 7/00; H01P 1/17

USPC ..... 342/361

See application file for complete search history.

(56) References Cited

U.S. PATENT DOCUMENTS

| | | | | |
|---|---|---|---|---|
| 3,089,142 | A | 5/1963 | Wickersham, Jr. | |
| 4,742,354 | A | 5/1988 | Wen et al. | |
| 5,608,413 | A * | 3/1997 | Macdonald | H01Q 1/243 343/700 MS |
| 5,793,330 | A | 8/1998 | Gans et al. | |
| 6,028,562 | A | 2/2000 | Guler et al. | |
| 6,473,053 | B1 * | 10/2002 | Krishmar-Junker | H01Q 5/55 343/756 |
| 6,563,470 | B2 * | 5/2003 | Em | H01P 1/171 343/756 |
| 6,906,685 | B2 | 6/2005 | English et al. | |
| 7,969,357 | B2 | 6/2011 | Russo et al. | |
| 2010/0171675 | A1 * | 7/2010 | Borja | H01Q 1/38 343/798 |
| 2011/0001682 | A1 * | 1/2011 | Rao | H01Q 9/0414 343/893 |
| 2012/0268818 | A1 | 10/2012 | Liu et al. | |

FOREIGN PATENT DOCUMENTS

| | | |
|---|---|---|
| EP | 2469653 | 6/2012 |
| WO | 03063288 | 7/2003 |

OTHER PUBLICATIONS

European Patent Office, "Extended European Search Report from EP Application No. 14173785.8 mailed Dec. 1, 2014", "from Foreign Counterpart of U.S. Appl. No. 13/939,259", Dec. 1, 2014, pp. 1-10, Published in: EP.

(Continued)

*Primary Examiner* — Harry Liu
(74) *Attorney, Agent, or Firm* — Fogg & Powers LLC

(57) ABSTRACT

A wideband frequency selective polarizer is provided. The wideband frequency selective polarizer includes arrays of first-frequency slots in at least two metallic sheets in at least two respective planes; and arrays of second-frequency slots interspersed with the arrays of first-frequency slots in the at least two metallic sheets in at least two respective planes. A polarization of a first-frequency radio frequency (RF) signal in a linearly-polarized-broadband-RF signal that propagates through the at least two planes is one of: rotated by a first angle in a negative direction; or un-rotated. A polarization of a second-frequency-RF signal in the linearly-polarized-broadband-RF signal is rotated by a second angle in a positive direction.

19 Claims, 16 Drawing Sheets

(56) References Cited

OTHER PUBLICATIONS

Zhao et al., "Broadband circular polarizer formed by stacked plasmonic metasurfaces", "Photonic and Phononic Properties of Engineered Nanostructures", Feb. 10, 2011, pp. 1-6, vol. 7946, No. 1, Publisher: SPIE.

"Extremely Wideband Waveguide Polariser System for Polarisation Alignment", "Electronics Letters", Jan. 1988, pp. 125-126, vol. 24, No. 2.

Meng et al., "Design of Dual-Polarized Slotted Waveguide Array", Nov. 2008, pp. 271-273, Publisher: IEEE.

* cited by examiner

FREQUENCY SELECTIVE POLARIZER

BACKGROUND

It is common for two-way high frequency satellite communication systems to use separate frequency bands for transmit and receive. For example, Ka-Band satellites use frequencies near 20 GHz for user reception and use frequencies near 30 GHz for user transmissions. The required polarizations are frequently of circular sense and are orthogonal at the transmission and receive bands. Some commercial and military Ka-Band satellites use Right Handed Circular Polarization (RHCP) on the uplink and Left Handed Circular Polarization (LHCP) on the downlink. Furthermore, there are cases that require switchable orthogonal polarizations (i.e., either RHCP/LCHP or LHCP/RHCP pairs for receive and transmit). Mobile user antennas often use array antennas in order to maximize the performance within a constrained available volume. For example, on an airborne mobile platform having an antenna in the radome, the height and width of the radome is typically constrained to reduce drag forces and vulnerability to a bird strike.

Such array antennas are frequently linearly polarized and use an external polarizing component to convert linear polarization to circular polarization. If the array antenna supports two orthogonal linear polarizations, a meanderline polarizer will naturally result in orthogonally circularly polarized radio frequency (RF) signals. Specifically, a single meanderline (or equivalent) polarizer with a single linearly polarized antenna converts linear polarization to a single sense circular polarization and not to orthogonal sense circular polarizations that are needed for a Ka-Band antenna operating at 20 GHz and at 30 GHz).

For the reasons stated above and for other reasons stated below which will become apparent to those skilled in the art upon reading and understanding the specification, there is a need in the art for improved systems and methods.

SUMMARY

The present application relates to a wideband frequency selective polarizer. The wideband frequency selective polarizer includes arrays of first-frequency slots in at least two metallic sheets in at least two respective planes; and arrays of second-frequency slots interspersed with the arrays of first-frequency slots in the at least two metallic sheets in at least two respective planes. A polarization of a first-frequency radio frequency (RF) signal in a linearly-polarized-broadband-RF signal that propagates through the at least two planes is one of: rotated by a first angle in a negative direction; or un-rotated. A polarization of a second-frequency-RF signal in the linearly-polarized-broadband-RF signal is rotated by a second angle in a positive direction.

DRAWINGS

Embodiments of the present invention can be more easily understood and further advantages and uses thereof more readily apparent, when considered in view of the description of the preferred embodiments and the following figures in which.

Figure 7A:
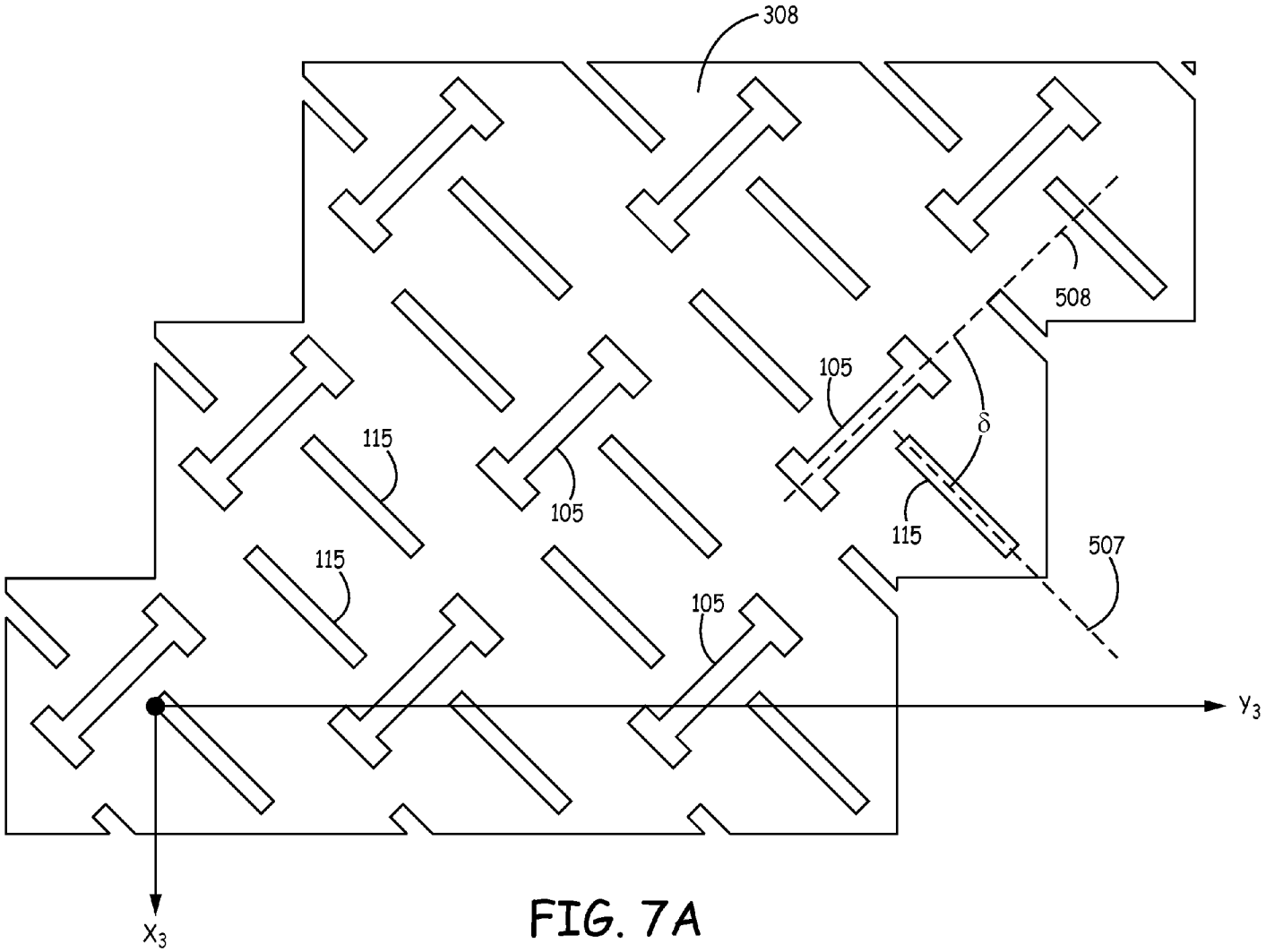
FIG. 7A illustrates a third-slot sheet of the wideband frequency selective polarizer of FIG. 3.
Figure 7B:
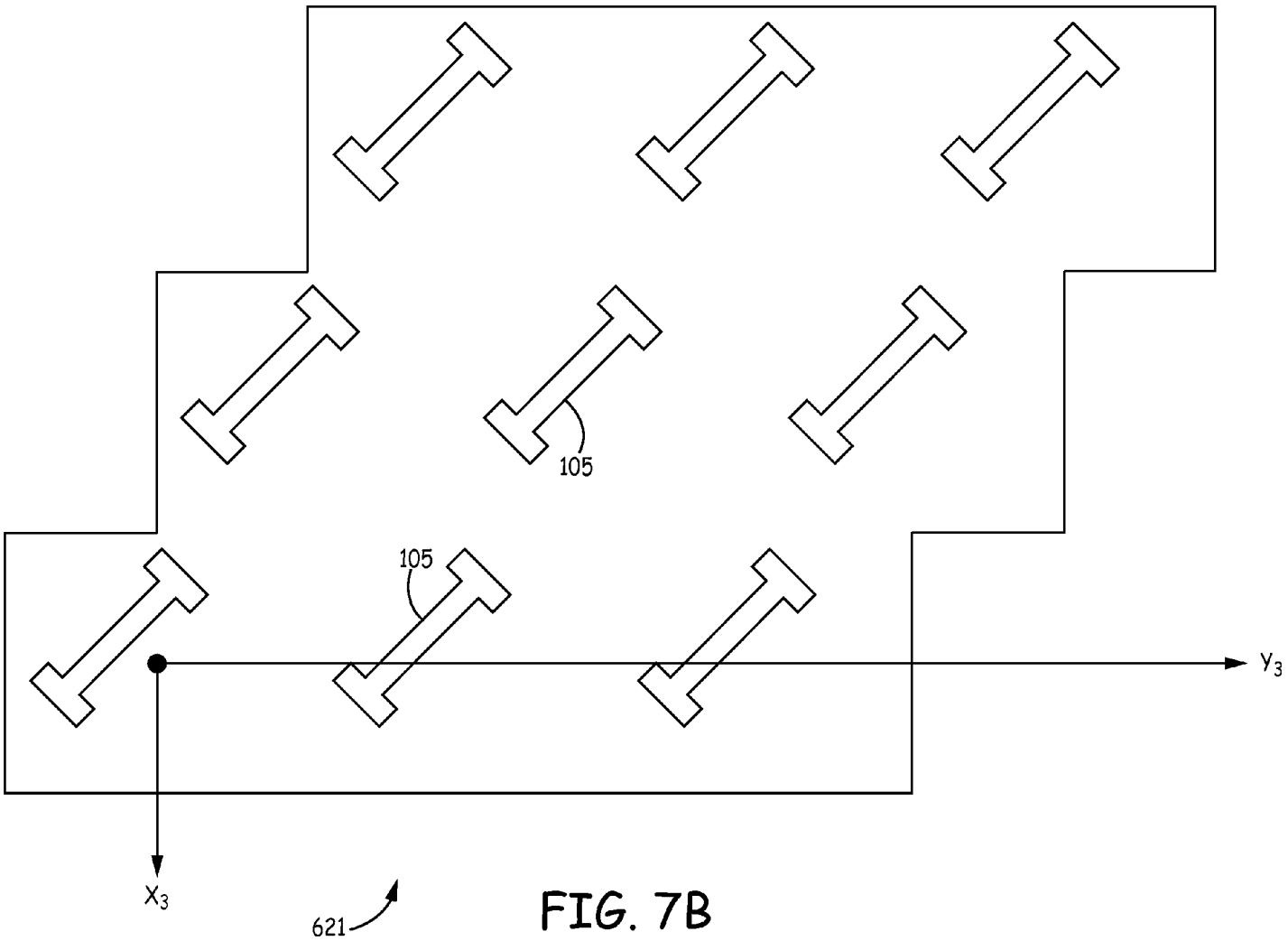
FIG. 7B illustrates a third-array of first-frequency slots in the third-slot sheet of FIG. 7A.
Figure 7C:
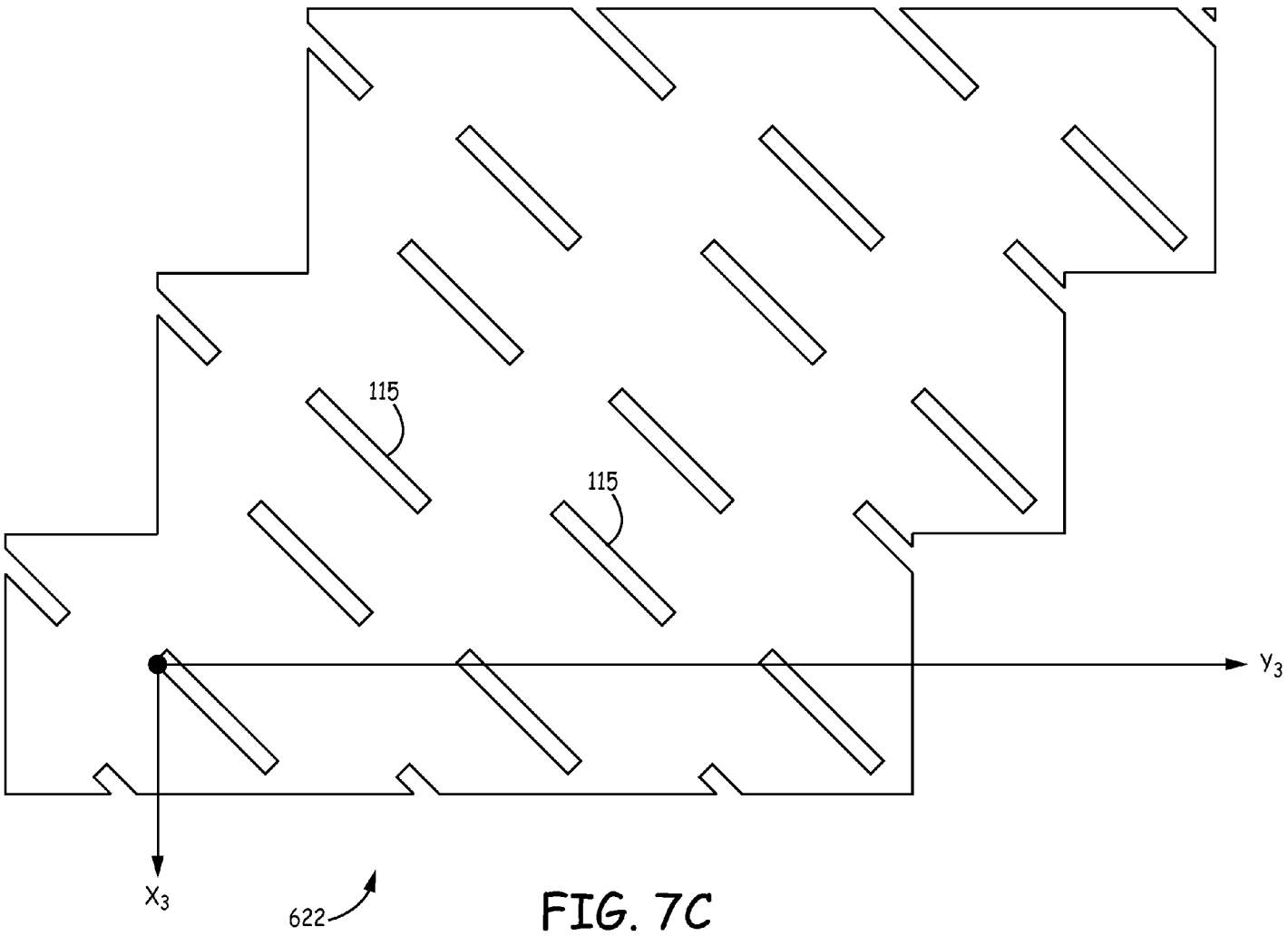
Figure 8:
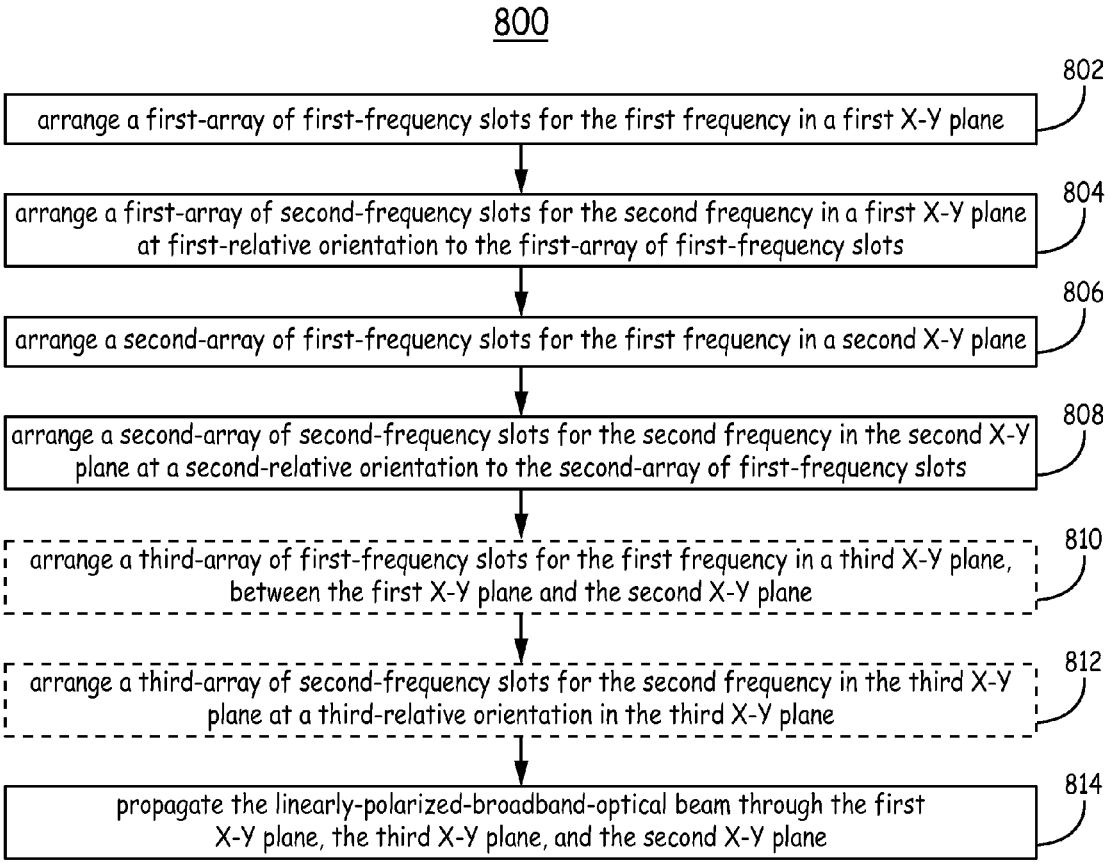

FIG. 7C illustrates a third-array of second-frequency slots in the third-slot sheet of FIG. 7A; and FIG. 8 is a flow diagram of one embodiment of a method of rotating an electric-field of a first-frequency radio frequency (RF) signal in a linearly-polarized-broadband-RF signal and an electric-field of a second-frequency-RF signal in the linearly-polarized-broadband-RF signal to be orthogonal to each other in accordance with the present invention.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

The wideband frequency selective polarizers described herein resolve the above mentioned problem with an array antenna to transmit and receive a linearly polarized broadband radio frequency (RF) signal, which includes signals at two separate frequencies. The wideband frequency selective polarizers described herein convert a linearly polarized broadband RF signal, having two RF frequency bands centered at $f_1$ and $f_2$ (FIG. 1B), to linearly polarized RF signals whose polarization is dependent on the frequency and are furthermore oriented 90 degrees to one another. The wideband frequency selective polarizers described herein can be used in a small volume (e.g., in a radome). If desired, an external polarizing component can be used to convert the orthogonal linear polarizations to LHCP and RHCP. Thus, the wideband frequency selective polarizers described herein allow the use of a dual (or wide) band antenna with only a single polarization in an application requiring dual polarization by converting a linearly polarized broadband RF signal to a fixed orthogonal pair (i.e. two linearly polarized RF signals with a 90 degree angular separation) of RF signals at the two separate frequencies. This provides cost and performance improvements in SATCOM antennas.

As defined herein, RF signals include electro-magnetic radiation at microwave and millimeter wave frequencies. The embodiments described herein are based on a single angle of incidence that corresponds to a plane wave approximation that is normal to the aperture of the antenna that includes the wideband frequency selective polarizer. However, the wideband frequency selective polarizer can be designed for RF signals with non-normal incidence and is applicable to a range of plane wave incidence to correspond to a phased array antenna rather than a fixed beam antenna.

Figure 1A:
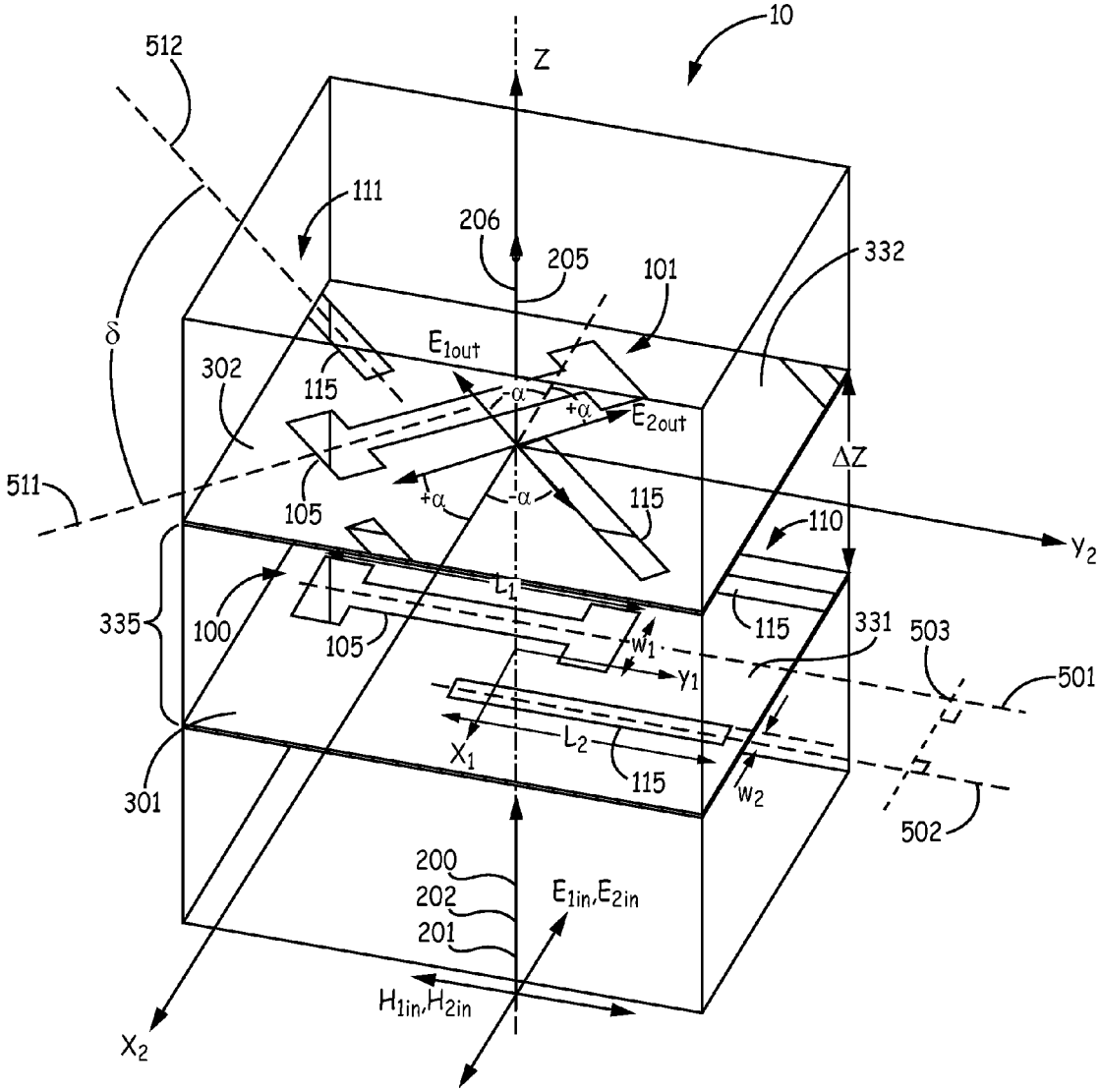
FIG. 1A illustrates an embodiment of a wideband frequency selective polarizer in accordance with the present invention.
Figure 1B:
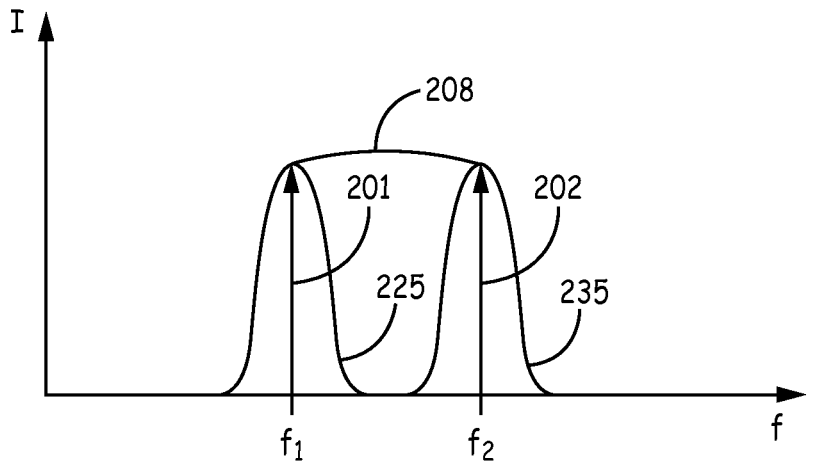
FIG. 1B illustrates an exemplary spectral range of the wideband frequency selective polarizer in accordance with the present invention.

FIG. 1A illustrates an embodiment of a wideband frequency selective polarizer 10 in accordance with the present invention. FIG. 1B illustrates an exemplary spectral range of the wideband frequency selective polarizer 10 in accordance with the present invention. FIG. 1B is a plot of intensity versus frequency. As shown in FIG. 1B, the first-frequency-RF signal 201 is represented generally at by the vector 201 at the $f_1$ along the frequency axis (f) and the second-frequency-RF signal 202 is represented generally at by the vector 202 at the $f_2$ along the frequency axis. As shown in FIG. 1B, the frequency $f_1$ of first-frequency-RF signal 201 is less than the frequency $f_2$ of the second-frequency-RF signal 202. The wideband frequency selective polarizers described herein, operate equally well if the frequency $f_1$ of first-frequency-RF signal 201 is greater than the frequency $f_2$ of the second-frequency-RF signal 202.

However, for consistency, as used herein, the terms "first frequency" and "lower frequency" are used interchangeably herein. Likewise, the terms "second frequency" and "higher frequency" are used interchangeably herein. Likewise, for consistency, as used herein, a plane wave incident in the +Z direction is a transmit signal and a plane wave incident in the −Z direction is a receive signal. The discussion herein is based on a transmit signal propagating in the +Z direction from a co-linearly polarized port in which both frequency signals are in the same polarization. One skilled in the art understands the wideband frequency selective polarizers described herein are passive and reciprocal devices, so the wideband frequency selective polarizer behaves similarly on receive.

The transmit linearly-polarized-broadband-RF signal 200 incident on the wideband frequency selective polarizer 10 is linearly polarized and has two frequencies $f_1$ and $f_2$. As shown in FIG. 1A, an electric-field $E_{1in}$ of a first-frequency-RF signal 201 (at lower frequency $f_1$) is polarized in the same direction as an electric-field $E_{2in}$ of a second-RF signal 202 frequency (i.e., higher frequency $f_2$). The first-frequency-RF signal 201 is linearly polarized with the E-field along the X direction. Likewise, the second-frequency-RF signal 202 is linearly polarized with the E-field along the X direction. Thus, the linearly-polarized-broadband-RF signal 200 includes the first-frequency-RF signal 201 and the second-frequency-RF signal 202, that are polarized in the same direction.

The wideband frequency selective polarizer 10 (FIG. 1A) has a first pass-band for the first frequency $f_1$ represented generally at 225 (FIG. 1B). The wideband frequency selective polarizer 10 (FIG. 1A) has a second pass-band for the second frequency $f_2$ represented generally at 235 (FIG. 1B). The spectral range of the wideband frequency selective polarizer 10 represented generally at 208 extends from the first pass-band 225 to the second pass-band 235. In one implementation of this embodiment, the lower frequency $f_1$ corresponds to the downlink frequency of Ka-Band satellites while the upper frequency $f_2$ corresponds to the uplink frequency band of the Ka-Band satellite. From the mobile user view, the uplink frequency band corresponds to the mobile terminal transmitting while the downlink frequency band corresponds to the mobile terminal receiving.

As shown in FIG. 1A, the wideband frequency selective polarizer 10, includes an array 100 of first-frequency slots represented generally at 105 in two metallic sheets 301 and 302 in two respective parallel X-Y planes represented generally at 331 and 332 and an array 110 of second-frequency slots represented generally at 115 in the at least two planes 331 and 332. The array 100 of first-frequency slots 105 is interspersed with the array 110 of second-frequency slots 115. The first frequency slots 105 are also referred to herein as "$f_1$ slots 105" or "lower frequency slots 105". The second frequency slots 115 are also referred to herein as "$f_2$ slots 115" or the "higher frequency slots 115". The slots are periodic with the fundamentally the same periodic structure, but there may be multiple slots in the periodic cell.

For ease of viewing, only one periodic cell is shown on a first-slot sheet 301 and a second-slot sheet 302 of FIG. 1A. The "first-slot sheet 301" is also referred to herein as "first metallic sheet 301". The "second-slot sheet 302" is also referred to herein as "second metallic sheet 302". However, it is to be understood that the periodic cell is one of a plurality of cells in an array of periodic cells. As shown in FIG. 1A, there is one lower frequency slot 105 per periodic cell on each layer for the lower frequency ($f_1$) and two higher frequency slots 115 per periodic cell for the higher frequency ($f_2$). By having two slots per periodic cell at the higher frequency $f_2$, the bandwidth at the higher frequency is increased as is known in the art. Wideband frequency selective polarizers are shown and described below that show a plurality of periodic cells.

The first plane 331 is spanned by the basis vectors $X_1Y_1$. The second plane 332 is spanned by the basis vectors $X_2Y_2$. The first-slot sheet 301 in the first plane 331 includes a periodic cell for two types of slots. In one implementation of this embodiment, the first-slot sheet 301 is a metal sheet on a dielectric material (not visible in FIG. 1A). An array 100 of first-frequency slots 105 shown in the single periodic cell of FIG. 1A has the first pass-band 225 (FIG. 1B) for the first frequency $f_1$. An array 110 of second-frequency slots 115 shown in the single periodic cell of FIG. 1A has the second pass-band 235 (FIG. 1B) for the second frequency $f_2$. Since the array 100 of first-frequency slots 105 is in the first plane 331 it is referred to herein as a first-array 100 of the first-frequency slots 105. Since the array 110 of second-frequency slots 115 is in the first plane 331 it is referred to herein as a first-array 110 of the second-frequency slots 115.

The first-array 100 of the first-frequency slots 105 and the first-array 110 of the second-frequency slots 115 have a first-relative orientation of 0 degrees. Specifically, the long extent of the first-frequency slots 105 and the long extent of the second-frequency slots 115 are parallel to each other (e.g., first-array of the first-frequency slots and the first-array of the second-frequency slots have a parallel orientation to each other). The first-array 100 of the first-frequency slots 105 shown in the single periodic cell of FIG. 1A is interspersed with the first-array 110 of the second-frequency slots 115 shown in the single periodic cell of FIG. 1A in the first plane 331. FIGS. 5A to 7C described below illustrate the expanded arrays of periodic cell of first-frequency slots 105 and second-frequency slots 115 in each of three different X-Y planes.

As shown in FIG. 1A, the first-frequency slots 105 have an I-beam shape and the second-frequency slots 115 have a rectangular shape. The first-frequency slots 105 and second-frequency slots 115 can be one of a variety of shapes to create the desired first pass-band 225 and second pass-band 235, respectively, as known to one skilled in the art. If the first-frequency slots 105 and second-frequency slots 115 have the same shape, one of the array of slots is smaller than the other array of slots. If the first frequency $f_1$ is less than the second frequency $f_2$ (as shown in FIG. 1B), the dimensional extents in X-Y plane of the second-frequency slots 115 (i.e., the length $L_2$ and width $W_2$) are smaller in dimension than the respective dimensional extents in X-Y plane of the first-frequency slots 105 (i.e., the length $L_1$ and width $W_1$, respectively). As is understood by one skilled in the art, the 'ends' of the I-slot load the slots so an I-slot resonates at a lower frequency than would it were rectangular in shape. Therefore an I-slot will affect the relative size and frequency of the first-frequency slots 105 and second-frequency slots 115. The larger frequency requires a smaller slot.

The shapes of the slots in the array of first-frequency slots 105 can be any appropriate shape, including but not limited to, a rectangular shape, an I-beam-shape, an arrow shape, and other shapes formed from one or more intersecting rectangular or curvilinear segments.

As shown in FIG. 1A, the second plane 332 is offset from the first plane 331 along a Z direction by the amount $\Delta Z$. The offset $\Delta Z$ is equal to about a quarter-wavelength of the average of a first wavelength $\lambda_1$ in the dielectric material and a second wavelength $\lambda_2$ in the dielectric material (e.g., $\lambda_{average}=(\lambda_1+\lambda_2)/2$). If there is no dielectric material, the offset $\Delta Z$ is equal to about a quarter-wavelength of the average of a first wavelength $\lambda_1$ in air and a second wavelength $\lambda_2$ in air. As is well known, the first wavelength $\lambda_1$ equals $nf_1/c$, where c/n is the speed of light in a material having an index of refraction of n. Likewise, the second wavelength $\lambda_2$ equals $nf_2/c$. Thus, the quarter-wavelength of the average of a first wavelength $\lambda_1$ and a second wavelength $\lambda_2$ equals $(\lambda_1+\lambda_2)/8$.

The second-slot sheet 302 is in the second plane 332 and also includes two arrays (represented generally by the periodic cell) of slots. The second-slot sheet 302 includes an array 101 of the first-frequency slots 105 having the first pass-band 225 for the first frequency $f_1$ and an array 111 of second-frequency slots 115 having the second pass-band 235 for the second frequency $f_2$. Since the array 101 of first-frequency slots 105 is in the second plane 332 it is referred to herein as a second-array 101 of the first-frequency slots 105. Since the array 111 of second-frequency slots 115 is in the second plane 332 it is referred to herein as a second-array 111 of the second-frequency slots 115. The second-array 101 of the first-frequency slots 105 is interspersed with the second-array 111 of the second-frequency slots 115 shown in the single periodic cell of FIG. 1A in the second plane 332.

The transmit first-frequency-RF signal 201 in the linearly-polarized-broadband-RF signal 200 propagates normally through the at least two planes 331 and 332 spanned by the basis vectors $X_1Y_1$ and $X_2Y_2$, respectively. The polarization of the transmit first-frequency-RF signal 201 is rotated by a first angle $\alpha$ in a negative direction ($-\alpha$). At the same time, the transmit second-frequency-RF signal 202 in the linearly-polarized-broadband-RF signal 200 propagates normally through the at least two planes 331 and 332 and so the polarization of the second-frequency-RF signal 202 is rotated by a second angle $\alpha$ in a positive direction ($+\alpha$).

The second-array 101 of the first-frequency slots 105 and the second-array 111 of second frequency slots 115 have a second-relative orientation (angle $\delta$) in the second-slot sheet 302 in the second plane 332. The absolute value of the difference between the first-relative orientation 0 in the first plane 331 and the second-relative orientation (angle $\delta$) in the second plane 332 is the sum of the absolute values of the first angle $|-\alpha|$ and the absolute value of the second angle $|+\alpha|$. As shown in FIG. 1A, the sum of the absolute values of the first angle $|-\alpha|$ and the second angle $|+\alpha|$ is twice the angle $\alpha$. Thus, the $2\alpha=\delta$. In one implementation of this embodiment, angle $\alpha$ equals 45 degrees so the sum of the absolute values of the first angle $|-45|$ and the second angle $|+45|$ is 90 degrees. In another implementation of this embodiment, the first and second angles are different angles. For example, the first angle in a negative direction can be ($-\alpha$) while the second angle in a positive direction can be different from $\alpha$. In this latter embodiment, the sum of the absolute value of the first angle $|-\alpha|$ and the absolute value of the second angle equals 90 degrees.

The wideband frequency selective polarizer 10 rotates the electric-field $E_{1in}$ of the transmit first-frequency-RF signal 201 in a direction opposite to a rotation of an electric-field $E_{2in}$ of the second-frequency $f_1$ RF signal 202. As shown in FIG. 1A, the electric-field $E_{1in}$ of the first-frequency-RF signal 201 is rotated by the first angle $-\alpha$ and is transmitted from the wideband frequency selective polarizer 10 as a first-frequency-RF signal 205 with an electric-field $E_{1out}$ that is at an angle $-\alpha$ relative to the electric-field $E_{1in}$ of the first-frequency-RF signal 201. Thus, the polarization of the first-frequency-RF signal 205 is rotated by the angle $\alpha$ in a negative direction.

The wideband frequency selective polarizer 10 functions to rotate the polarization of the transmit electric-field $E_{2in}$ of the second-frequency-RF signal 202 by the second angle $\alpha$, but in the opposite direction from the rotation of the first-frequency-RF signal 205. Thus, the polarization of the second-frequency-RF signal 202 is rotated by the angle $\alpha$ in the positive direction. As shown in FIG. 1A, the transmit electric-field $E_{2in}$ of the transmit second-frequency-RF signal 202 is rotated by an angle minus $-\alpha$ and is transmitted from the wideband frequency selective polarizer 10 as a second-frequency-RF signal 206 with an electric-field $E_{2out}$ that is at an angle $+\alpha$ relative to the electric-field $E_{2in}$ of the second-frequency-RF signal 202.

The linearly polarized first-frequency-RF signal 205 has an electric-field $E_{1out}$ that is at an angle $2\alpha$ relative the electric-field $E_{2out}$ of the linearly polarized transmitted second-frequency-RF signal 206. In this manner, the first-frequency-RF signal 201 propagated through the at least two planes $X_1Y_1$ and $X_2Y_2$ is polarized orthogonally to the second-frequency-RF signal 202 propagated through the at least two planes $X_1Y_1$ and $X_2Y_2$. This exemplary case is shown in FIG. 1A.

In one implementation of this embodiment, the first-slot sheet 301 and the second-slot sheet 302 are copper-clad dielectric sheets in which the slot patterns are chemically etched. In another implementation of this embodiment, the first-slot sheet 301 and the second-slot sheet 302 are formed from a sheet of copper, aluminum, other metals, or alloys of two or more metals.

The space between the first-slot sheet 301 and the second-slot sheet 302 is referred to herein as an offset-region 335.

In one implementation of this embodiment, the off-set region is filled with air. In another implementation of this embodiment, the off-set region is at least partially filled with a dielectric material 340. This latter embodiment is shown in FIG. 2.

Figure 2:
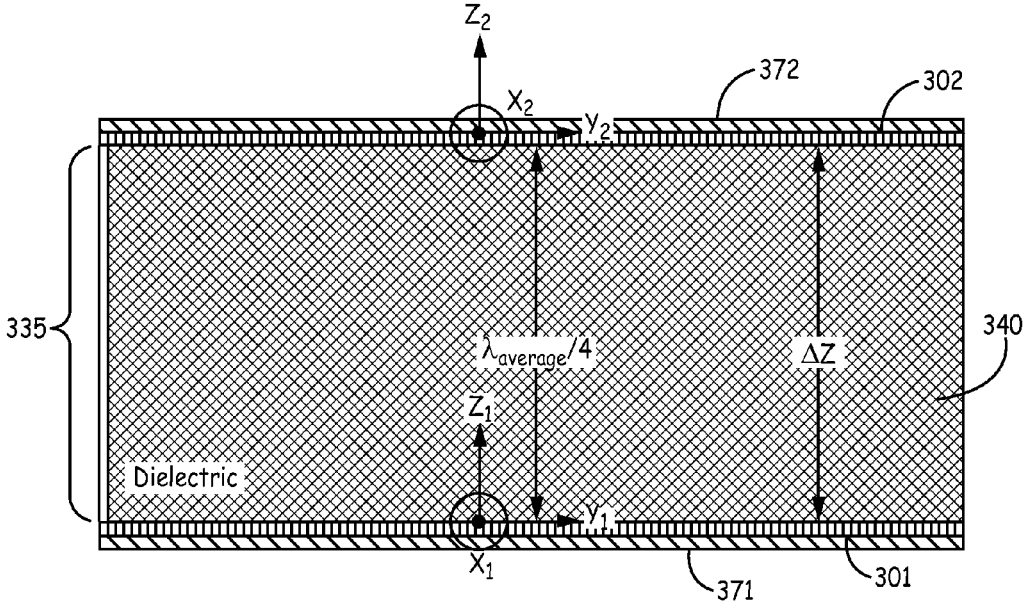
FIG. 2 illustrates an embodiment of an offset-region at least partially filled with a dielectric material in accordance with the present invention.

FIG. 2 illustrates an embodiment of an offset-region 335 at filled with a dielectric material 340 in accordance with the present invention. The first-slot sheet 301 is shown adjacent to a supportive dielectric substrate 371. The first-slot sheet 301 is positioned between the dielectric substrate 371 and the dielectric material 340 in the off-set region 335. The second-slot sheet 302 is shown adjacent to a supportive dielectric substrate 372. The second-slot sheet 302 is positioned between the dielectric substrate 372 and the dielectric material 340 in the off-set region 335. As shown in FIG. 2, the supportive dielectric substrate 371 and dielectric substrate 372 are exposed to the outside environment and help prevent oxidation of the metal in the first-slot sheet 301 and second-slot sheet 302. In one implementation of this embodiment, the dielectric material 340 is a low dielectric material such as low density foam or a honeycomb material.

Figure 3:
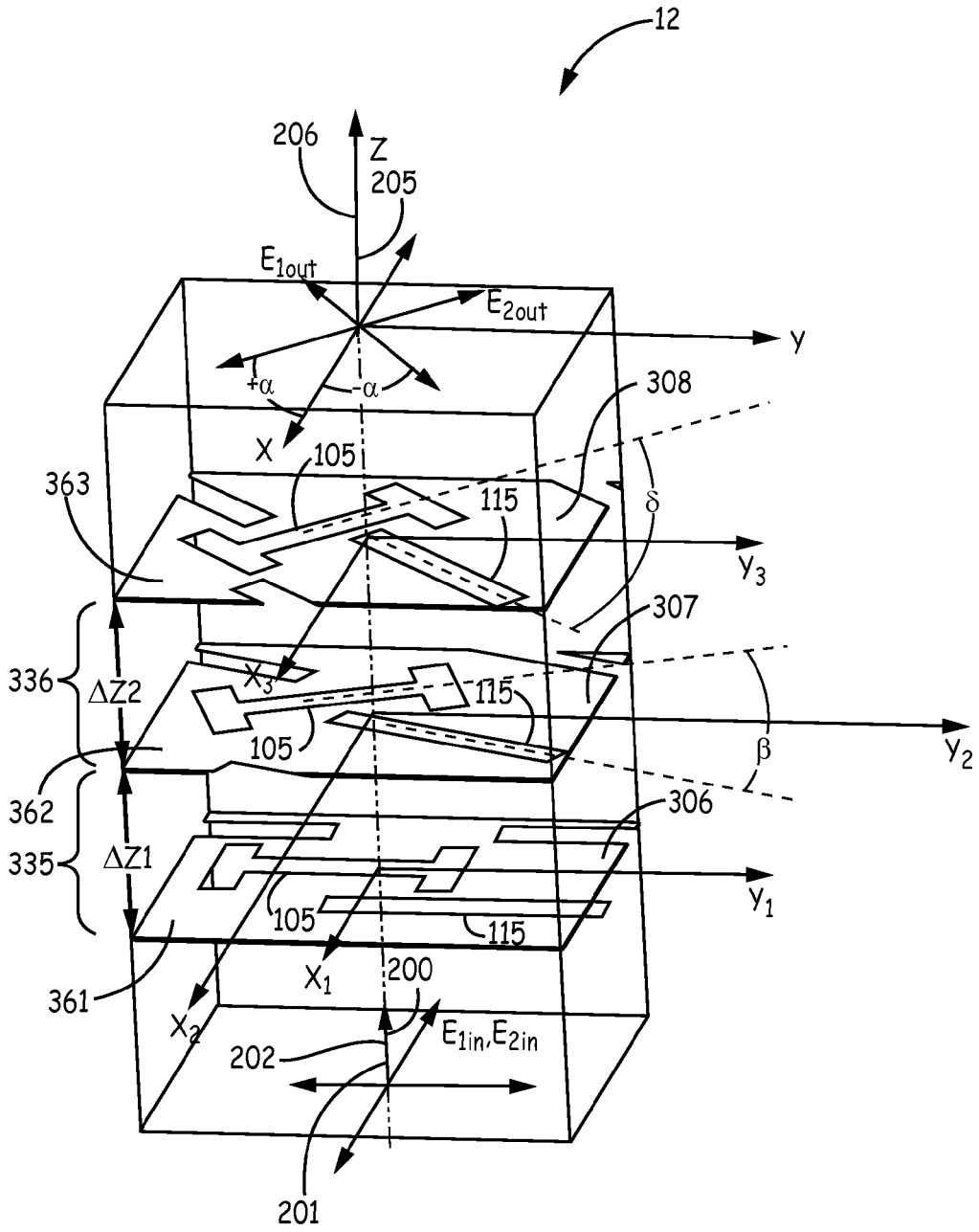
FIGS. 3 and 4 illustrate embodiments of wideband frequency selective polarizers in accordance with the present invention.
Figure 4:
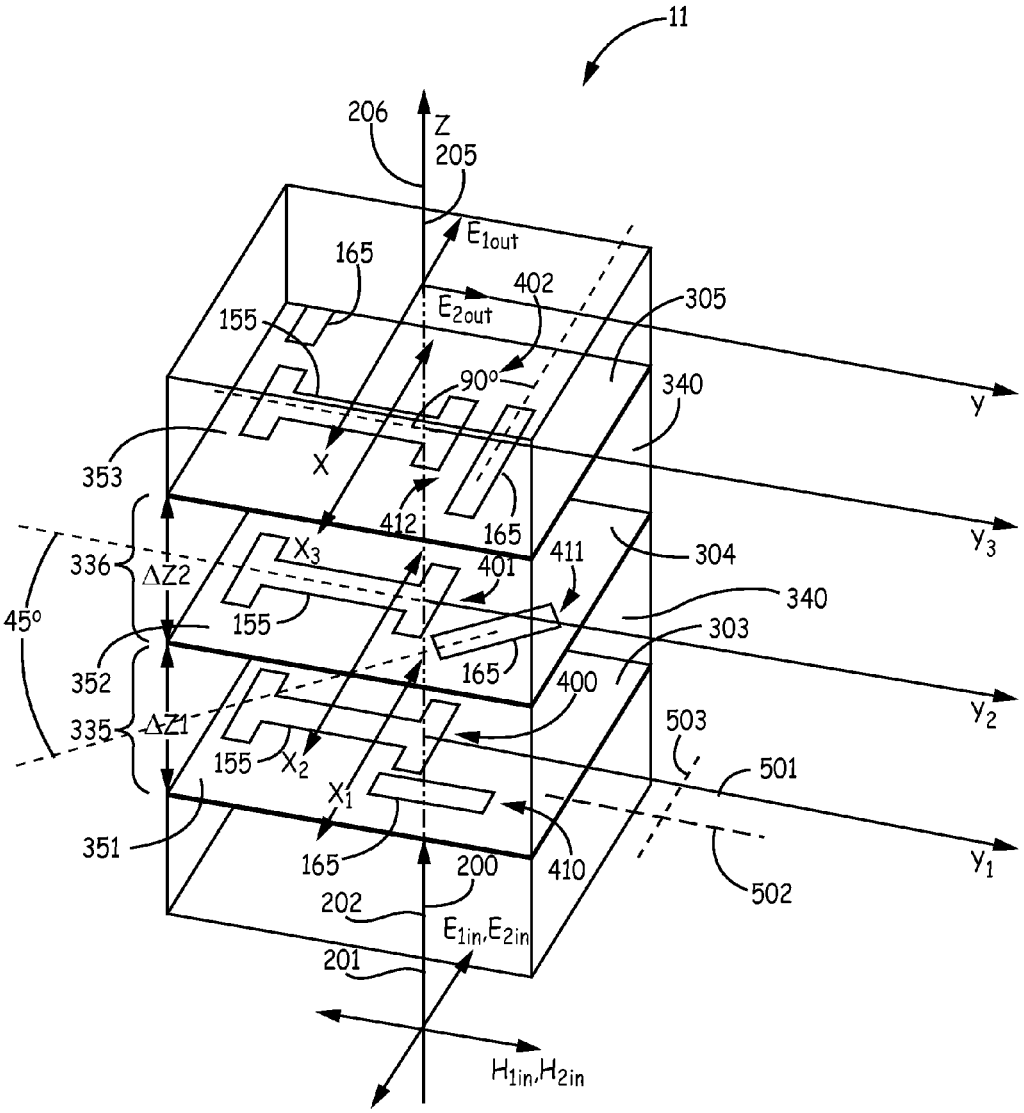

Other embodiments of the wideband frequency selective polarizer include more than two metal sheets in more than two respective planes as is shown in FIGS. 3 and 4. FIGS. 3 and 4 illustrate embodiments of wideband frequency selective polarizers 11 and 12, respectively, in accordance with the present invention.

FIG. 3 illustrates a wideband frequency selective polarizer 12. The wideband frequency selective polarizer 12 includes three metallic sheets 306, 307, and 308 in three parallel X-Y planes represented generally at 361, 362, and 363, with interspersed arrays of slots. For ease of viewing, only one periodic cell is shown on each of a first-slot sheet 306, a second-slot sheet 307, and a third-slot sheet 308. However, it is to be understood that the periodic cell is one of a plurality of cells in an array of periodic cells. As shown in FIG. 3, there is one slot per periodic cell on each layer for the lower frequency ($f_1$) and two slots per periodic cell for the higher frequency ($f_2$). The "first-slot sheet 306" is also referred to herein as "first metallic sheet 306". The "second-slot sheet 307" is also referred to herein as "second metallic sheet 307". The "third-slot sheet 308" is also referred to herein as "third metallic sheet 308". FIGS. 5A-5C and 6A-7C illustrate enlarged views of the slot sheets 306-308 of the wideband frequency selective polarizer 12 of FIG. 3.

The wideband frequency selective polarizer 12 includes a first-slot sheet 306 in the first plane 361, a second-slot sheet 307 in the second plane 362, and third-slot sheet 308 in the third plane 362. The first plane 361 is spanned by the basis vectors $X_1Y_1$. The second plane 362 is spanned by the basis vectors $X_2Y_2$. The second plane 362 is offset from the first plane 361 along the Z direction by a first offset $\Delta Z_1$. The third plane 363 is spanned by the basis vectors $X_3Y_3$. The third plane 363 is offset from the second plane 362 along a Z direction by a second offset $\Delta Z_2$. Thus, the third plane 363 is offset from the first plane 361 along the Z axis by an offset of $\Delta Z_1+\Delta Z_2$ plus the thickness of the second metal sheet 307. The offsets $\Delta Z_1$ and $\Delta Z_2$ each equal about a quarter-wavelength of the average of a first wavelength $\lambda_1$ and a second wavelength $\lambda_2$, in the dielectric material or air as appropriate, where the average wavelength equals $(\lambda_1+\lambda_2)/2$. Thus, offsets $\Delta Z_1$ and $\Delta Z_2$ are equal to about $(\lambda_1+\lambda_2)/8$. As defined herein, the $i^{th}$ offset $\Delta Z_i$ includes all the materials (i.e., dielectric substrates, metal sheets, etc.) that are between the planes.

Figure 5A:
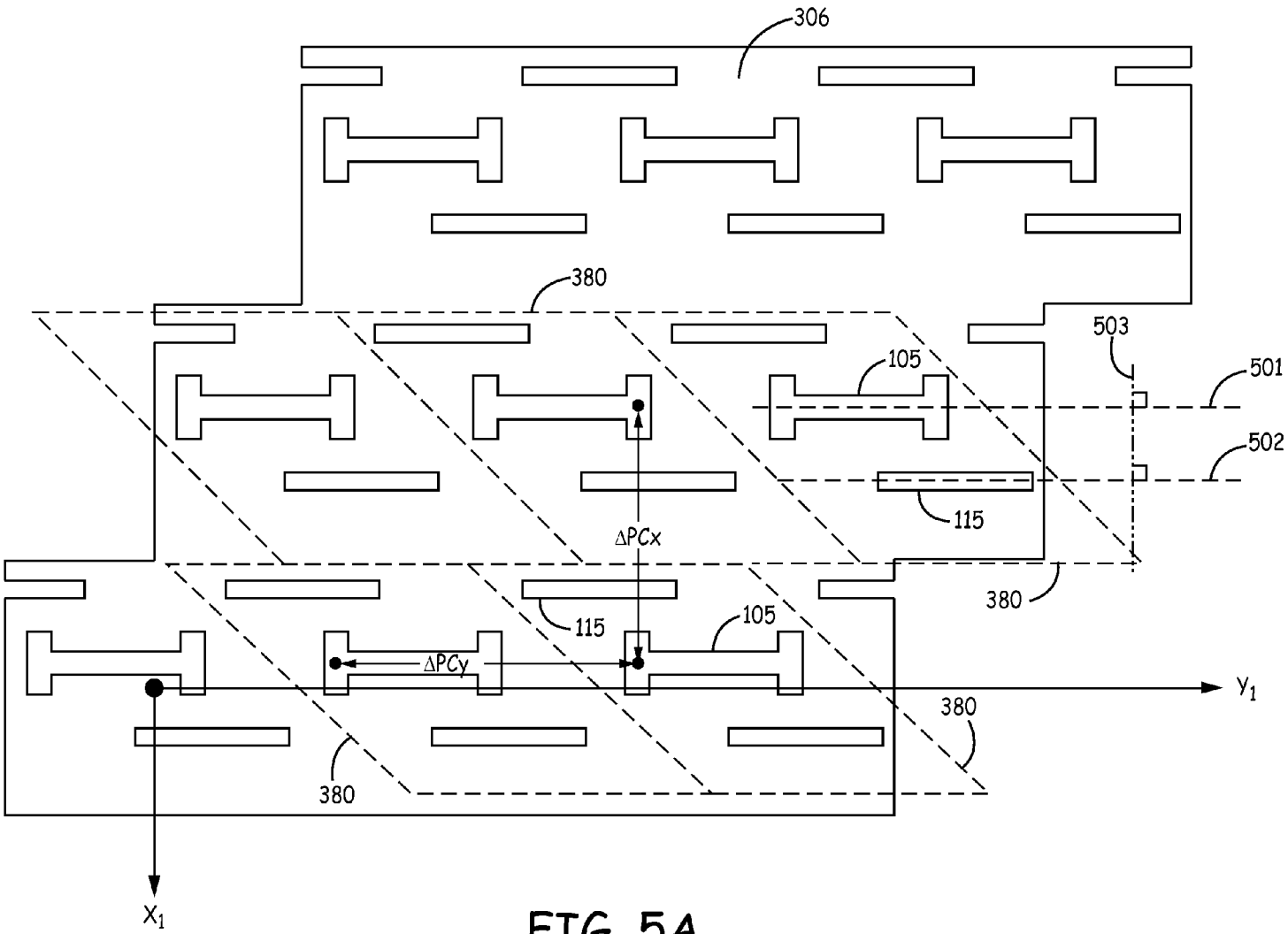
FIG. 5A illustrates a first-slot sheet of the wideband frequency selective polarizer of FIG. 3.
Figure 5B:
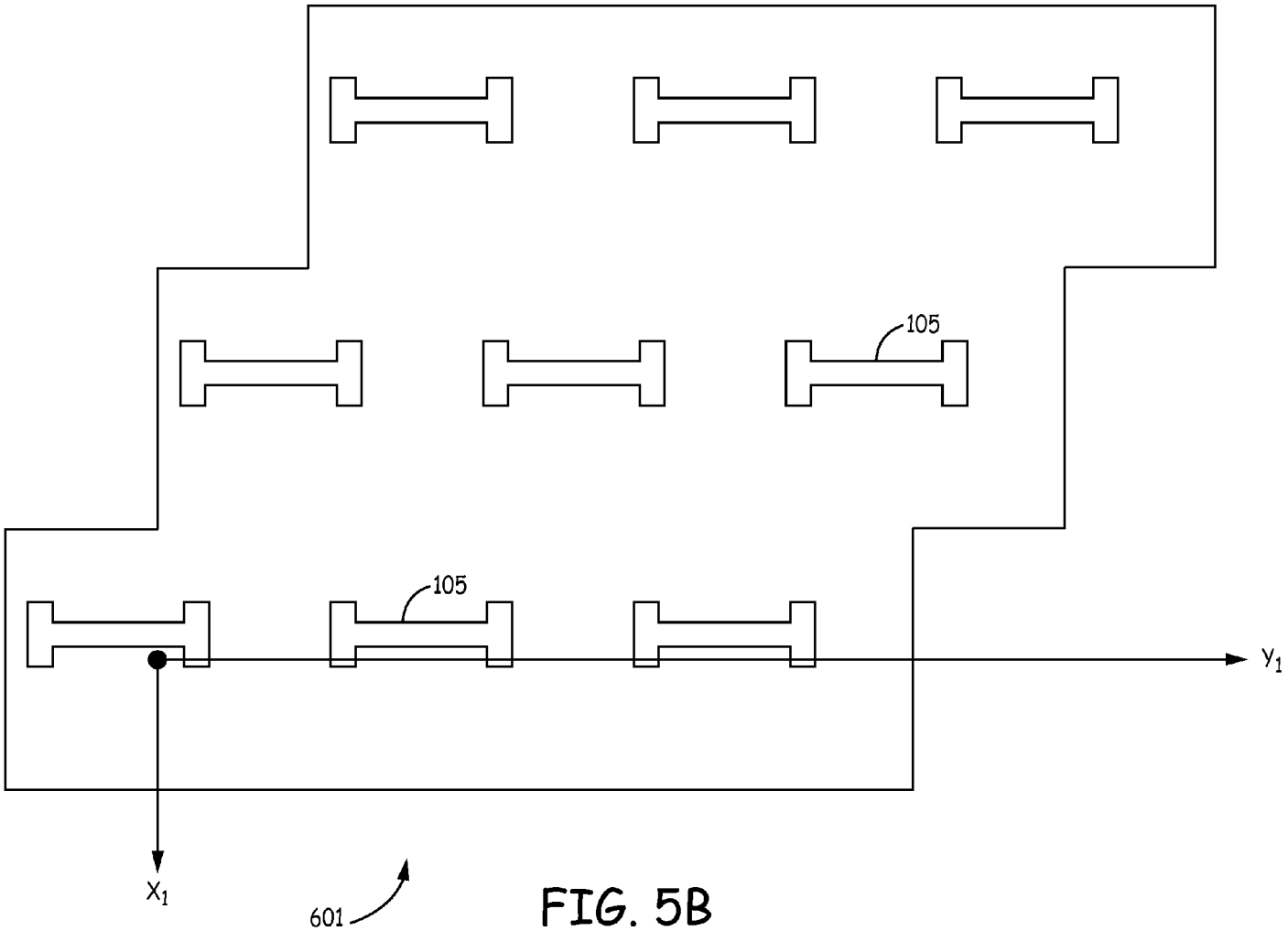
FIG. 5B illustrates a first-array of first-frequency slots in the first-slot sheet of FIG. 5A.
Figure 5C:
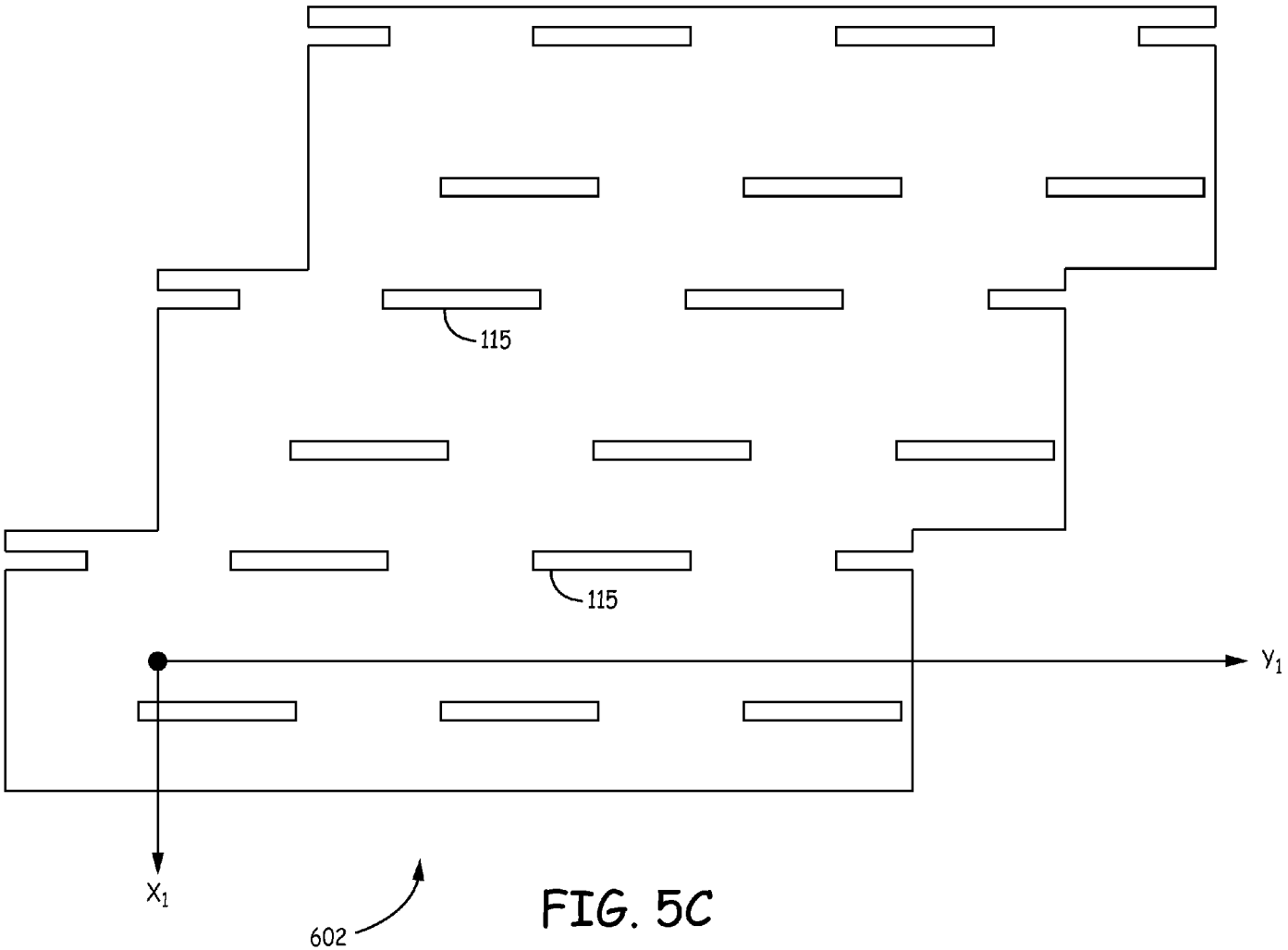
FIG. 5C illustrates a first-array of second-frequency slots in the first-slot sheet of FIG. 5A.

The first-slot sheet 306 includes a first-array 601 (FIG. 5B) of the first-frequency slots 105 having a first pass-band 225 for the first frequency $f_1$ and a first-array 602 (FIG. 5C) of the second-frequency slots 115 having a second pass-band 235 for the second frequency $f_2$. The first-array 601 of the first-frequency slots 105 and the first-array 602 of the second-frequency slots 115 are interspersed and have a first-relative orientation that is a parallel orientation (0 degrees) to each other. As shown in FIG. 5A, a selected one of the long extents of the first-frequency slots 105 is shown parallel to the $Y_1$ axis, which is also represented generally at line 501. The long extent of the second-frequency slots 115 is shown parallel to the line represented generally at 502 (FIG. 5A). The line 503 (FIG. 5A) that crosses both lines 501 and 502 is perpendicular to both lines 501 and 502. Thus, lines 501 and 502 are parallel to each other in the first plane 361.

Figure 6A:
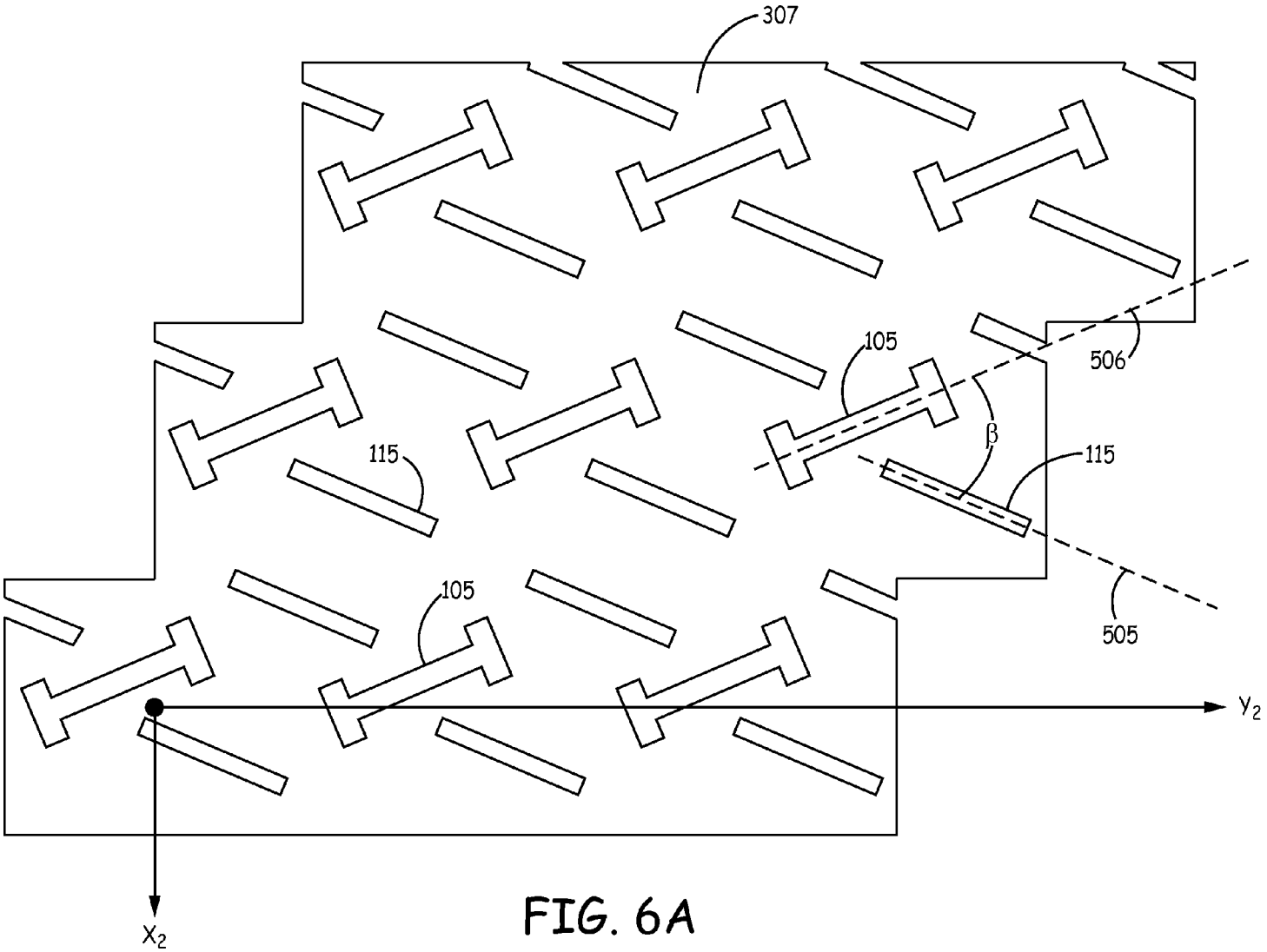
FIG. 6A illustrates a second-slot sheet of the wideband frequency selective polarizer of FIG. 3.

The second-slot sheet 307 in the second plane 362 includes a second-array 611 (FIG. 6B) of the first-frequency slots 105 having the first pass-band 225 for the first frequency $f_1$ and a second-array 612 (FIG. 6C) of the second-frequency slots 115 having the second pass-band 235 for the second frequency $f_2$. The second-array 611 of the first-frequency slots 105 and the second-array 612 of second frequency slots 115 are interspersed and have a second-relative orientation (shown as angle $\beta$ in FIGS. 3 and 6A) in the second plane 362. Specifically, the selected long extent of the first-frequency slots 105 and the long extent of the second frequency slots 115 subtend an angle of $\beta$ as shown in FIGS. 3 and 6A. A first offset-region 335 is between the first-slot sheet 306 and the second-slot sheet 307. In one implementation of this embodiment, air fills the first offset-region 335. In another implementation of this embodiment, a dielectric material (other than air) fills the first offset-region 335.

The third-slot sheet 308 in the third plane 363 includes a third-array 621 (FIG. 7B) of the first-frequency slots 105 having the first pass-band 225 for the first frequency $f_1$ and a third-array 622 (FIG. 7C) of the second-frequency slots 115 having the second pass-band 235 for the second frequency $f_2$. The third-array 621 of the first-frequency slots 105 and the third-array 622 of second frequency slots 115 are interspersed and have a third-relative orientation (angle $\delta$ as shown in FIGS. 3 and 7A) in the third plane 363. Specifically, the selected long extent of the first-frequency slots 105 and the long extent of the second-frequency slots 115 subtend an angle $\delta$ as shown in FIGS. 3 and 7A. A second offset-region 336 is between the second-slot sheet 307 and the third-slot sheet 308. In one implementation of this embodiment, air fills the second offset-region 336. In another implementation of this embodiment, a dielectric material (other than air) fills the second offset-region 336.

The linearly-polarized-broadband-RF signal 200 incident on the wideband frequency selective polarizer 12 is linearly polarized and has two frequencies $f_1$ and $f_2$ as described above with reference to FIG. 1B. The wideband frequency selective polarizer 12 rotates the transmit electric-field $E_{1in}$ (i.e., the polarization) of the first-frequency-RF signal 201 in a direction opposite to a rotation of transmit electric-field $E_{2in}$ (i.e., the polarization) of the second-frequency $f_1$ RF signal 202. Specifically, as shown in FIG. 3, the electric-field $E_{1in}$ of the first-frequency-RF signal 201 is rotated by an angle ($-\alpha$) and is transmitted from the wideband frequency selective polarizer 12 as an electric-field $E_{1out}$ of a first-frequency-RF signal 205 that is at an angle $-\alpha$ relative to the electric-field $E_{1in}$ of the first-frequency-RF signal 201.

In one implementation of this embodiment, the first-slot sheet 306 and the third-slot sheet 308 are adjacent to a respective supportive dielectric substrate (e.g., the dielectric substrates 371 and 372 shown in FIG. 2) that are arranged to prevent oxidation of the first-slot sheet 306 and the third-slot sheet 308. The second-slot sheet 307 is also supported by a dielectric substrate. Since the second-slot sheet 307 is encased by the dielectric material 340 in the off-set regions 335 and 336, the dielectric substrate of the second-slot sheet 307 can be on either side of the second-slot sheet 307.

As shown in FIG. 3, the second layer rotates the electric field (i.e., the polarization) by approximately +/−22.5 degrees while the third layer completes the electric field (polarization) rotation to +/−45 degrees. This transition of angles in three layers allows for a low reflection to be achieved while satisfying the polarization rotation.

FIG. 4 illustrates a wideband frequency selective polarizer 11. The wideband frequency selective polarizer 11 is similar to the wideband frequency selective polarizer 12 in that there are three metal sheets as in the wideband frequency selective polarizer 12. The wideband frequency selective polarizer 11 includes three metallic sheets 303, 304, and 305 in three parallel X-Y planes represented generally at 351, 352, and 353, with interspersed arrays of slots. For ease of viewing, only one periodic cell is shown on each of a first-slot sheet 303, a second-slot sheet 304, and a third-slot sheet 305. However, it is to be understood that the periodic cell is one of a plurality of cells in an array of periodic cells. As shown in FIG. 4, there is one slot per periodic cell on each layer for the lower frequency ($f_1$) and one slot per periodic cell for the higher frequency ($f_2$). The "first-slot sheet 303" is also referred to herein as "first metallic sheet 303". The "second-slot sheet 304" is also referred to herein as "second metallic sheet 304". The "third-slot sheet 305" is also referred to herein as "third metallic sheet 305".

The wideband frequency selective polarizer 11 includes a first-slot sheet 303 in the first plane 351, a second-slot sheet 304 in the second plane 352, and third-slot sheet 305 in the third plane 352. The first plane 351 is spanned by the basis vectors $X_1Y_1$. The second plane 352 is spanned by the basis vectors $X_2Y_2$. The second plane 352 is offset from the first plane 351 along the Z direction by a first offset $\Delta Z_1$. The third plane 353 is spanned by the basis vectors $X_3Y_3$. The third plane 353 is offset from the second plane 352 along a Z direction by a second offset $\Delta Z_2$. Thus, the third plane 353 is offset from the first plane 351 along the Z axis by an offset of $\Delta Z_1+\Delta Z_2$ plus the thickness of the second metal sheet 304. The offsets $\Delta Z_1$ and $\Delta Z_2$ each equal about a quarter-wavelength of the average of a first wavelength $\lambda_1$ and a second wavelength $\lambda_2$, in the dielectric material or air as appropriate, where the average wavelength equals $(\lambda_1+\lambda_2)/2$. Thus, offsets $\Delta Z_1$ and $\Delta Z_2$ are each equal to about $(\lambda_1+\lambda_2)/8$.

The first-slot sheet 303 includes a first-array 400 of the first-frequency slots 155 having a first pass-band 225 for the first frequency $f_1$ and a first-array 410 of the second-frequency slots 165 having a second pass-band 235 for the second frequency $f_2$. The first-array 400 of the first-frequency slots 155 and the first-array 410 of the second-frequency slots 165 have a first-relative orientation (0 degrees or parallel). A selected one of the long extents of the first-frequency slots 155 is shown parallel to the $Y_1$ axis, which is also represented generally at line 501. The long extent of the second-frequency slots 165 is shown parallel to the line represented generally at 502. The line 503 that crosses both lines 501 and 502 is perpendicular to both lines 501 and 502. Thus, lines 501 and 502 are parallel to each other in the first plane 351. As shown in FIG. 4, the first-frequency slots 155 have an I-beam shape and the second-frequency slots 165 have a rectangular shape.

The second-slot sheet 304 in the second plane 352 includes a second-array 401 of the first-frequency slots 155 having the first pass-band 225 for the first frequency $f_1$ and a second-array 411 of the second-frequency slots 165 having the second pass-band 235 for the second frequency $f_2$. The second-array 401 of the first-frequency slots 155 and the second-array 411 of second frequency slots 165 have a second-relative orientation (45 degrees) in the second plane 352. Specifically, the selected long extent of the first-frequency slots 155 and the long extent of the second frequency slots 165 subtend an angle of 45 degrees, as shown in FIG. 4. A first offset-region 335 is between the first-slot sheet 303 and the second-slot sheet 304. In one implementation of this embodiment, air fills the first offset-region 335. In another implementation of this embodiment, a dielectric material (other than air) fills the first offset-region 335.

The third-slot sheet 305 in the third plane 353 includes a third-array 402 of the first-frequency slots 155 having the first pass-band 225 for the first frequency $f_1$ and a third-array 412 of the second-frequency slots 165 having the second pass-band 235 for the second frequency $f_2$. The third-array 402 of the first-frequency slots 155 and the third-array 412 of second frequency slots 165 have a third-relative orientation (90 degrees) in the third plane 353. Specifically, the selected long extent of the first-frequency slots 155 and the long extent of the second-frequency slots 165 subtend an angle of 90 degrees, as shown in FIG. 4. A second offset-region 336 is between the second-slot sheet 304 and the third-slot sheet 305. In one implementation of this embodiment, air fills the second offset-region 336. In another implementation of this embodiment, a dielectric material (other than air) fills the second offset-region 336.

The linearly-polarized-broadband-RF signal 200 incident on the wideband frequency selective polarizer 11 is linearly polarized and has two frequencies $f_1$ and $f_2$ as described above with reference to FIG. 1B. The wideband frequency selective polarizer 11 functions to rotate the polarization of the transmit electric-field $E_{2in}$ of the second-frequency-RF signal 202 by 90 degrees while the first-frequency-RF signal 205 is un-rotated. The polarization of the first-frequency RF signal is un-rotated, and the polarization of the second-frequency RF signal is rotated by 90 degrees. In another implementation of this embodiment, the polarization of the first-frequency RF signal is rotated by 90 degrees, and the polarization of the second-frequency RF signal is un-rotated. In this manner, the wideband frequency selective polarizer 11 rotates a linearly polarized signal into two orthogonally polarized signals. The orthogonal circularly polarized RF signals may be obtained with this configuration in conjunction with a meanderliner polarizer positioned at the output of the wideband frequency selective polarizer 11 as understood by one skilled in the art.

In one implementation of this embodiment, the first-slot sheet 303 and the third-slot sheet 305 are adjacent to a respective supportive dielectric substrate (e.g., the dielectric substrates 371 and 372 shown in FIG. 2) that are arranged to prevent oxidation of the first-slot sheet 303 and the third-slot sheet 305. The second-slot sheet 304 is also supported by a dielectric substrate. Since the second-slot sheet 304 is encased by the dielectric material 340 in the off-set regions 335 and 336, the dielectric substrate of the second-slot sheet 304 can be on either side of the second-slot sheet 304.

FIG. 5A-7C are now described in detail with reference to FIG. 3. FIG. 5A illustrates a first-slot sheet 306 of the wideband frequency selective polarizer 12 of FIG. 3. FIG. 5B illustrates a first-array 601 of first-frequency slots 105 in the first-slot sheet 306 of FIG. 5A. FIG. 5C illustrates a first-array 602 of second-frequency slots 115 in the first-slot sheet 306 of FIG. 5A. The first-slot sheet 306 includes an array of periodic cells represented generally at 380. Periodic cells are defined by the lattice vectors that can be selected as desired and do not have a specific shape. As shown, each periodic cell includes one first-frequency slot 105 and two second-frequency slots 115. If a rectangular view of a single periodic cell of each of the first-array 601 of first-frequency slots 105 and the first-array 602 of second-frequency slots 115 were outlined some slots would be dissected. In fact a rectangular periodic cell was used for the electromagnetic analysis.

The spacing represented generally at $\Delta PC_x$ and $\Delta PC_y$ of the periodic cells 380 is designed according to the desired application. For example, when the wideband frequency selective polarizer 12 is used for a single incidence plane wave, the $\Delta PC_x$ and $\Delta PC_y$ spacing can be less than one wavelength without performance degradation. When the wideband frequency selective polarizer 12 is used in a phased array antenna, the $\Delta PC_x$ and $\Delta PC_y$ spacing of the periodic cells 380 is closer to one-half wavelength to prevent degradation of performance from grating lobes.

The first-slot sheet 306 in the first plane 361 includes the first-array 601 (FIG. 5B) of the first-frequency slots 105 having a first pass-band 225 for the first frequency $f_1$ and the first-array 602 (FIG. 5C) of the second-frequency slots 115 having a second pass-band 235 for the second frequency $f_2$. The first-array 601 of the first-frequency slots 105 is interspersed with the first-array 602 of the second-frequency slots 115 in the first plane 361 (FIG. 3) in which the first-slot sheet 306 (FIG. 5A) is positioned.

The first-array 601 (FIG. 5B) of the first-frequency slots 105 and the interspersed first-array 602 (FIG. 5C) of the second-frequency slots 165 have a first-relative orientation (0 degrees). As is shown in FIG. 5A, the long extent of the first-frequency slots 105 is shown parallel to the line 501. The long extent of the second-frequency slots 115 is shown parallel to the line 502. The line 503 that crosses both lines 501 and 502 is perpendicular to both lines 501 and 502. Thus, lines 501 and 502 are parallel to each other in the first plane 361.

Figure 5D:
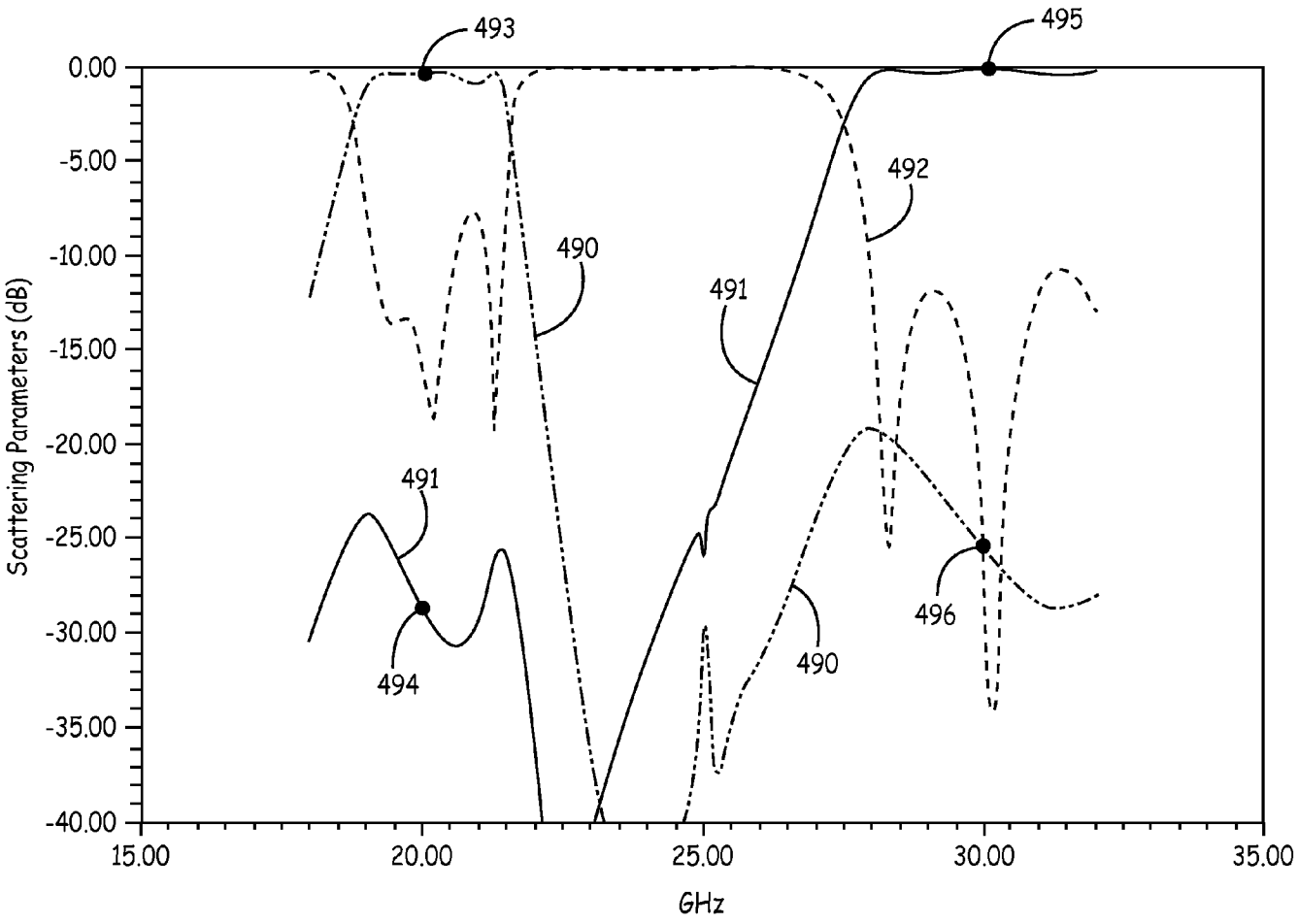
FIG. 5D shows plots of pass bands for two frequencies and a return loss for the wideband frequency selective polarizer of FIG. 3.

FIG. 5D shows plots of pass bands for two frequencies and a return loss for the wideband frequency selective polarizer of FIG. 3. The vertical axis of the plot is scattering parameters and the horizontal axis of the plots is frequency in GHz. The pass band for the lower frequency is shown in plot 490. The pass band for the higher frequency is shown in plot 491. The return loss is shown as plot 492. At 20 GHz, the pass band for the lower frequency (plot 490) is indicated by the dot labeled 493. The low frequency signal is at about 0 dB at 20 GHz. At 20 GHz, the pass band for the higher frequency (plot 491) is indicated by the dot labeled 494. The high frequency signal is at about −28 dB at 20 GHz. At 30 GHz, the pass band for the lower frequency (plot 490) is indicated by the dot labeled 496. The low frequency signal is at about −25 dB at 30 GHz. At 30 GHz, the pass band for the higher frequency (plot 491) is indicated by the dot labeled 495. The high frequency signal is at about 0 dB at 30 GHz. Thus, the isolation between the two polarizations is high.

Figure 6B:
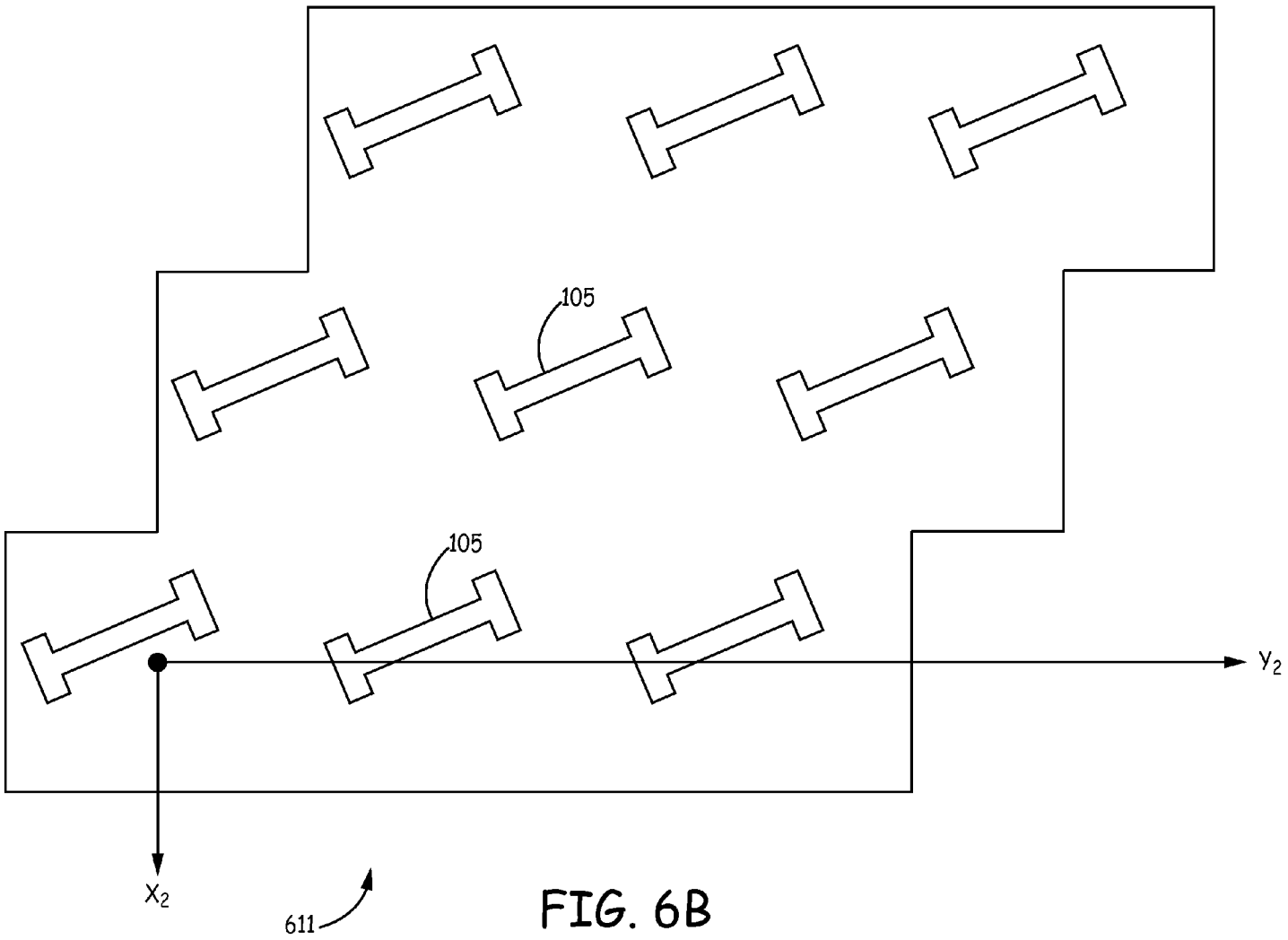
FIG. 6B illustrates a second-array of first-frequency slots in the second-slot sheet of FIG. 6A.
Figure 6C:
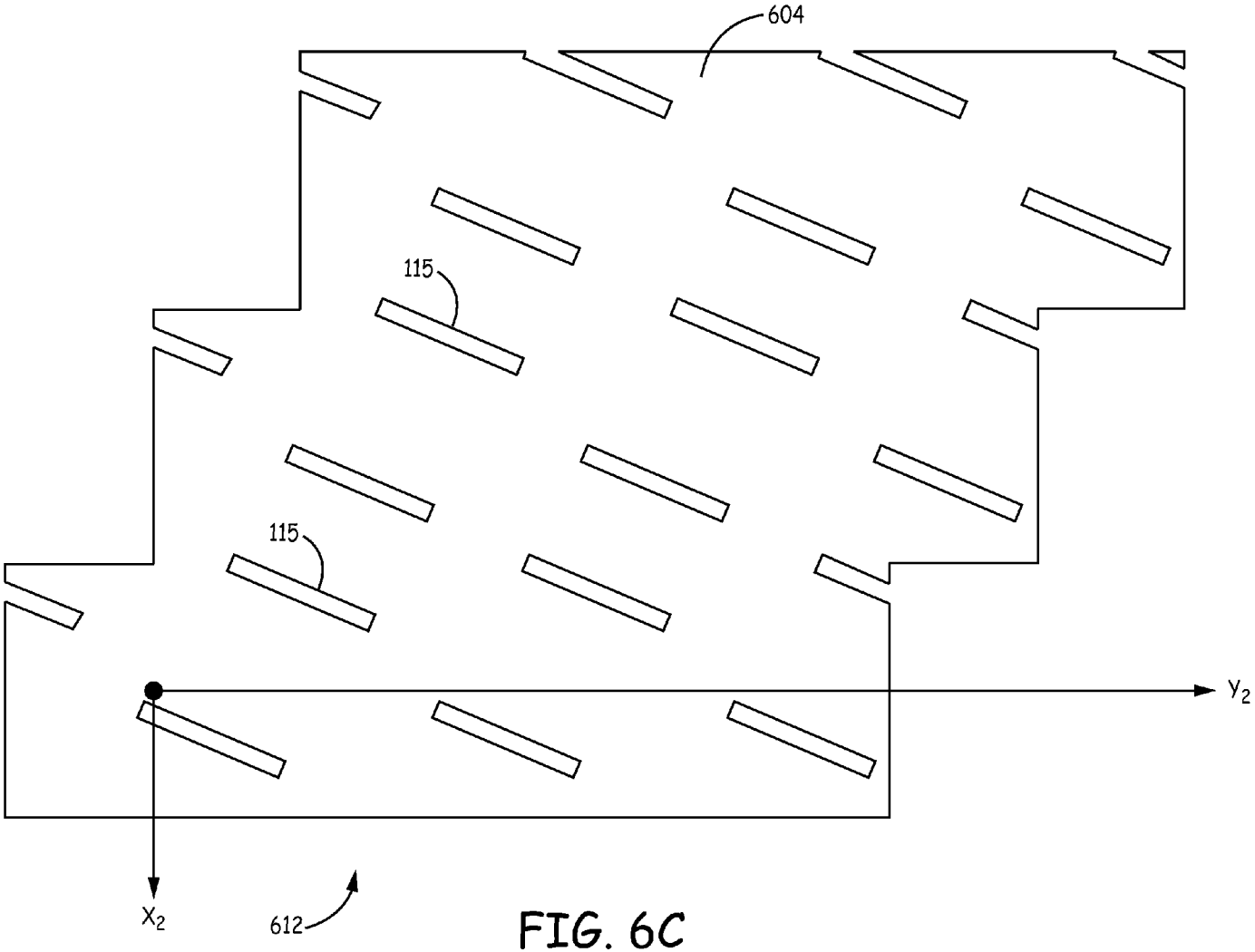
FIG. 6C illustrates a second-array of second-frequency slots in the second-slot sheet of FIG. 6A.

FIG. 6A illustrates a second-slot sheet 307 of the wideband frequency selective polarizer 12 of FIG. 3. FIG. 6B illustrates a second-array 611 of first-frequency slots 105 in the second-slot sheet 307 of FIG. 6A. FIG. 6C illustrates a second-array 612 of second-frequency slots 115 in the second-slot sheet 307 of FIG. 6A. Only a portion of each of the second-array 611 of first-frequency slots 105 and the second-array 612 of second-frequency slots 115 is shown in FIG. 3, for ease of viewing. The second-slot sheet 307 in the second plane 362 includes the second-array 611 of the first-frequency slots 115 having the first pass-band 225 for the first frequency $f_1$ and the second-array 612 of the second-frequency slots 115 having the second pass-band 235 for the second frequency $f_2$. The second-array 611 of first-frequency slots 105 is interspersed with the second-array 612 of second-frequency slots 115 in the second plane 362 (FIG. 3) in which the second-slot sheet 307 (FIG. 5A) is positioned.

As is shown in FIG. 6A, the long extent of the first-frequency slots 105 and the long extent of the second frequency slots 115 subtend an angle of β between them. Thus, the second-array 611 of the first-frequency slots 105 and the second-array 612 of second frequency slots 115 have a second-relative orientation (angle β).

FIG. 7A illustrates a third-slot sheet 308 of the wideband frequency selective polarizer 12 of FIG. 3. FIG. 7B illustrates a third-array 621 of first-frequency slots 105 in third-slot sheet 308 of FIG. 7A. FIG. 7C illustrates a third-array 622 of second-frequency slots 115 in the third-slot sheet 308 of FIG. 7A. Only a portion of each of the third-array 621 of first-frequency slots 105 and the third-array 622 of second-frequency slots 115 is shown in FIG. 3, for ease of viewing. The third-slot sheet 308 in the third plane 363 includes the third-array 621 of the first-frequency slots 105 having the first pass-band 225 for the first frequency $f_1$ and the third-array 622 of the second-frequency slots 115 having the second pass-band 235 for the second frequency $f_2$. The third-array 621 of first-frequency slots 105 is interspersed with the third-array 622 of second-frequency slots 115 in the third-slot sheet 308 in the third plane 363 (FIG. 3) in which the third-slot sheet 308 (FIG. 5A) is positioned.

As is shown in FIG. 7A, the long extent of the first-frequency slots 115 and the long extent of the second frequency slots 115 subtend an angle of δ. Thus, third-array 621 of the first-frequency slots 105 and the third-array 622 of second frequency slots 115 have a third-relative orientation (angle δ). As shown in FIG. 7A, the angle δ is 90 degrees, the third-array 621 of the first-frequency slots 105 and the third-array 622 of second frequency slots 115 have an orthogonal orientation to each other.

FIG. 8 is a flow diagram of one embodiment of a method 800 of rotating an electric-field of a first-frequency radio frequency (RF) signal in a linearly-polarized-broadband-RF signal and an electric-field of a second-frequency-RF signal in the linearly-polarized-broadband-RF signal to be orthogonal to each other in accordance with the present invention. Specifically, a transmit electric-field $E_{1in}$ of a first-frequency-RF signal 201 in a linearly-polarized-broadband-RF signal 200 to be orthogonal to a transmit electric-field $E_{2in}$ of a second-frequency-RF signal 202 in the linearly-polarized-broadband-RF signal 200 in accordance with the present invention. The linearly-polarized-broadband-RF signal 200 includes the first-frequency-RF signal 201 and the second-frequency-RF signal 202 (FIGS. 1A, 3, and 4). When the linearly-polarized-broadband-RF signal 200 is transmitted through the wideband frequency selective polarizer formed in blocks 802-812, the transmit electric-field $E_{1in}$ of the first-frequency-RF signal 201 is parallel to the transmit electric-field $E_{2in}$ of the second-frequency-RF signal 202 (FIGS. 1A, 3, and 4). After the linearly-polarized-broadband-RF signal 200 has propagated through the wideband frequency selective polarizer formed in blocks 802-812, the electric-field $E_{1out}$ of the transmitted first-frequency-RF signal 205 is rotated to be perpendicular to the electric-field $E_{2out}$ of a transmitted second-frequency-RF signal 206 (FIGS. 1A, 3, and 4).

At block 802, a first-array 100 of first-frequency slots 105 (FIG. 1A) having a first pass-band 225 (FIG. 1B) for the first frequency $f_1$ is arranged in a first metallic sheet in a first X-Y plane. The first X-Y plane is also referred to herein as a first plane $X_1Y_1$ or first plane 331. At block 804, a first-array 110 of second-frequency slots 115 (FIG. 1A) having a second pass-band 235 (FIG. 1B) for the second frequency $f_2$, is arranged in the first metallic sheet in the first plane $X_1$-$Y_1$. The first-array 100 of first-frequency slots 105 and the first-array 110 of the second-frequency slots 115 (FIG. 1A) have a first-relative orientation (0 degrees) in the first plane $X_1$-$Y_1$. The first-array 100 of the first-frequency slots 105 is interspersed with the first-array 110 of the second-frequency slots 115. In one implementation of this embodiment, first-array of the first-frequency slots and the first-array of the second-frequency slots are etched in a copper layer cladding a dielectric.

In one implementation of this embodiment, the slots described herein are formed by etching the arranged arrays of slots in a metal coated dielectric sheet. In one implementation of this embodiment, the slots described herein are formed by punching the arranged arrays of slots in a metal sheet. In at least the latter embodiment, the blocks 802 and 804 occur at the same time. In yet another implementation of this embodiment, the slots are laser etched into the material.

At block 806, a second-array 101 of first-frequency slots 105 having the first pass-band 225 for the first frequency $f_1$ is arranged in a second metallic sheet in a second X-Y plane. The second X-Y plane is also referred to herein as a second plane $X_2$-$Y_2$ or second plane 332. At block 808, a second-array 111 of second-frequency slots 115 having the second pass-band 235 for the second frequency $f_2$ is arranged in the second metallic sheet in the second plane $X_2$-$Y_2$. The second-array 101 of the first-frequency slots 105 is interspersed with the second-array 111 of the second-frequency slots 115. The second-array 101 of the first-frequency slots 105 and the second-array 111 of second frequency slots 115 have a second-relative orientation (e.g., angle $2\alpha$) in the second plane $X_2$-$Y_2$. In one implementation of this embodiment, second-array of the first-frequency slots and the second-array of the second-frequency slots are etched in a copper layer cladding a dielectric.

Blocks 810 and 812 are optional. Blocks 810 and 812 are implemented when the linearly-polarized-broadband-RF signal 200 is rotated in a wideband frequency selective polarizer that includes three metal sheets, such as first-slot sheet 306, second-slot sheet 307, and third-slot sheet 308 in the respective first plane 361, second plane 362, and third plane 363 shown in FIG. 3. Blocks 810 and 812 are implemented when the first frequency of the linearly-polarized-broadband-RF signal 200 is not rotated and the second frequency of the linearly-polarized-broadband-RF signal 200 is rotated by 90 degrees. If blocks 810 and 812 are not implemented, the linearly-polarized-broadband-RF signal 200 is rotated in a wideband frequency selective polarizer 10 that includes two metal sheets, such as first-slot sheet 301 and second-slot sheet 302 in respective first plane 331 and second plane 332 as shown in FIG. 1A.

At block 810, a third-array 100 of first-frequency slots 105 having the first pass-band 225 for the first frequency $f_1$ is arranged in a third metallic sheet in a third X-Y plane. The third X-Y plane is also referred to herein as a third plane $X_3$-$Y_3$. This third plane $X_3$-$Y_3$ is between the first plane $X_1$-$Y_1$ and the second plane $X_2$-$Y_2$.

At block 812, a third-array 110 of second-frequency slots 115 having the second pass-band 235 for the second frequency $f_2$ is arranged in the third metallic sheet in the third X-Y plane. The third-array 621 of the first-frequency slots 105 is interspersed with the third-array 622 of the second-frequency slots 115. The third-array of the first-frequency slots and the third-array of second frequency slots have a third-relative orientation (angle $\beta$) (FIG. 6A) in the third plane $X_3$-$Y_3$, which is shown as second metal sheet 307 in FIGS. 4 and 6A. In one implementation of this embodiment, the third-array of the first-frequency slots and the third-array of the second-frequency slots are etched in a copper layer cladding a dielectric.

At block 814, the linearly-polarized-broadband-RF signal 200 is propagated normally (e.g., in the Z direction) through the first plane $X_1$-$Y_1$ and the second plane $X_2$-$Y_2$. If blocks 810 and 812 are implemented, then at block 814, the linearly-polarized-broadband-RF signal 200 is propagated normally (e.g., in the Z direction) through the first plane $X_1$-$Y_1$, the third plane $X_3$-$Y_3$, and the second plane $X_2$-$Y_2$. In the embodiment in which blocks 810 and 812 are implemented, the first plane $X_1$-$Y_1$, the third plane $X_3$-$Y_3$, and the second plane $X_2$-$Y_2$ of blocks 810 and 812 correlate to the respective the first plane 361, second plane 362, and third plane 363 shown in FIG. 4.

The embodiments of wideband frequency selective polarizers described herein rotate a linearly polarized RF signal into two linear polarized signals that have an angle of $2\alpha$ between them. If a is selected to be 45 degrees, the wideband frequency selective polarizers described herein rotate a linearly polarized signal into two orthogonally polarized signals. In one implementation of this embodiment, the linearly polarized signal is in a linearly polarized wideband RF signal. For example, a vertical polarized signal may be rotated by +45 degrees at K-Band and by −45 degrees at the Ka-Band. The resulting polarization transformation, in conjunction with a meanderline polarizer positioned at the output of the wideband frequency selective polarizer, converts the orthogonal linear polarized RF signals to orthogonal circularly polarized signals as desired.

A linearly polarized scanning phased array can be used with one of the embodiments of wideband frequency selective polarizers described herein to enable an antenna to communicate to a satellite with orthogonal linear polarizations. This latter application requires the spacing of the periodic cells to be about or less than one-half wavelength to prevent degradation of performance from grating lobes. In this embodiment, the wideband frequency selective polarizer is designed for RF signals with non-normal incidence and is applicable to a range of plane wave incidence to correspond to a phased array antenna rather than a fixed beam antenna.

In a reversed sense, the described frequency selective polarizer can be used to combine two linearly polarized and orthogonal antenna RF signal outputs into a single broadband linearly polarized RF signal. In conjunction with a meanderline polarizer this enables both low frequency and high frequency signals to be co-circularly polarized and should be contrasted with the Ka-Band satellite requirement where orthogonal circular polarization is needed.

Example Embodiments

Example 1 includes a wideband frequency selective polarizer, comprising: arrays of first-frequency slots in at least two metallic sheets in at least two respective planes; and arrays of second-frequency slots interspersed with the arrays of first-frequency slots in the at least two metallic sheets in at least two respective planes, wherein a polarization of a first-frequency radio frequency (RF) signal in a linearly-polarized-broadband-RF signal that propagates through the at least two planes is one of: rotated by a first angle in a negative direction; or un-rotated, and wherein a polarization of a second-frequency-RF signal in the linearly-polarized-broadband-RF signal is rotated by a second angle in a positive direction.

Example 2 includes the wideband frequency selective polarizer of Example 1, wherein the polarization of the first-frequency radio frequency (RF) signal is rotated by the first angle, wherein the first angle and the second angle are forty-five degrees, wherein the first-frequency-RF signal transmitted through the at least two planes is polarized orthogonally to the second-frequency-RF signal transmitted through the at least two planes.

Example 3 includes the wideband frequency selective polarizer of any of Examples 1-2, wherein the polarization of the first-frequency radio frequency (RF) signal is rotated by the first angle, wherein the at least two planes comprise a first X-Y plane and a second X-Y plane, and wherein the at least two metallic sheets include a first-slot sheet and a second-slot sheet, the wideband frequency selective polarizer further comprising: the first-slot sheet in the first X-Y plane, the first-slot sheet including: a first-array of the first-frequency slots having a first pass-band for the first frequency, and a first-array of the second-frequency slots having a second pass-band for the second frequency, the first-array of the first-frequency slots and the first-array of the second-frequency slots having a first-relative orientation in the first X-Y plane; and the second-slot sheet in the second X-Y plane, the second X-Y plane offset from the first X-Y plane along a z direction, the second-slot sheet including: a second-array of the first-frequency slots having the first pass-band for the first frequency; and a second-array of the second-frequency slots having the second pass-band for the second frequency, the second-array of the first-frequency slots and the second-array of second frequency slots having a second-relative orientation in the second X-Y plane, wherein a sum of the absolute value of the first angle and the absolute value of the second angle is ninety-degrees.

Example 4 includes the wideband frequency selective polarizer of Example 3, wherein the first-array of the first-frequency slots is interspersed with the first-array of the second-frequency slots in the first X-Y plane, and wherein the second-array of the first-frequency slots is interspersed with the second-array of the second-frequency slots in the second X-Y plane.

Example 5 includes the wideband frequency selective polarizer of any of Examples 1-4, wherein an offset-region is at least partially filled with a dielectric material.

Example 6 includes the wideband frequency selective polarizer of Example 5, wherein the at least two planes comprise a first X-Y plane, a second X-Y plane, and a third X-Y plane, and wherein the at least two metallic sheets include a first-slot sheet, a second-slot sheet, and third-slot sheet, the wideband frequency selective polarizer further comprising: the first-slot sheet in the first X-Y plane, the first-slot sheet including: a first-array of the first-frequency slots having a first pass-band for the first frequency, and a first-array of the second-frequency slots having a second pass-band for the second frequency, the first-array of the first-frequency slots and the first-array of the second-frequency slots having a first-relative orientation in the first X-Y plane; and the second-slot sheet in the second X-Y plane, the second X-Y plane offset from the first X-Y plane along a z direction by a first offset, the second-slot sheet including: a second-array of the first-frequency slots having the first pass-band for the first frequency; and a second-array of the second-frequency slots having the second pass-band for the second frequency, the second-array of the first-frequency slots and the second-array of second frequency slots having a second-relative orientation in the second X-Y plane; and the third-slot sheet in the third X-Y plane, the third X-Y plane offset from the second X-Y plane along the z direction by a second offset, the third-slot sheet including: a third-array of the first-frequency slots having the first pass-band for the first frequency; and a third-array of the second-frequency slots having the second pass-band for the second frequency, the third-array of the first-frequency slots and the third-array of second frequency slots having a third-relative orientation in the third X-Y plane.

Example 7 includes the wideband frequency selective polarizer of Example 6, wherein the first offset and the second offset are equal to about a quarter-wavelength of the average of a first wavelength and a second wavelength.

Example 8 includes the wideband frequency selective polarizer of any of Examples 6-7, wherein the first-array of the first-frequency slots in the first X-Y plane are orientated parallel to the second-array of the first-frequency slots in the second X-Y plane, and wherein the first-array of the first-frequency slots in the first X-Y plane are orientated parallel to the third-array of the first-frequency slots in the third X-Y plane.

Example 9 includes the wideband frequency selective polarizer of Example 8, wherein first-relative orientation of the first-array of the first-frequency slots and the first-array of the second-frequency slots is parallel, and wherein the second-relative orientation of the second-array of the first-frequency slots and the second-array of the second-frequency slots is 45 degrees. wherein the third-relative orientation the third-array of the first-frequency slots and the third-array of second frequency slots is 90 degrees, wherein the polarization of the first-frequency RF signal is un-rotated, and wherein the polarization of the second-frequency RF signal is rotated by 90 degrees.

Example 10 includes a method of rotating an electric-field of a first-frequency radio frequency (RF) signal in a linearly-polarized-broadband-RF signal and an electric-field of a second-frequency-RF signal in the linearly-polarized-broadband-RF signal to be orthogonal to each other, the method comprising: arranging a first-array of first-frequency slots having a first pass-band for the first frequency in a first metallic sheet in a first X-Y plane; arranging a first-array of second-frequency slots having a second pass-band for the second frequency in the first metallic sheet in the first X-Y plane, wherein the first-array of first-frequency slots and the first-array of the second-frequency slots are interspersed with a first-relative orientation in the first X-Y plane; arranging a second-array of first-frequency slots having the first pass-band for the first frequency in a second metallic sheet in a second X-Y plane; arranging a second-array of second-frequency slots having the second pass-band for the second frequency in the second metallic sheet in the second X-Y plane, wherein the second-array of the first-frequency slots and the second-array of second frequency slots are interspersed with a second-relative orientation in the second X-Y plane, and wherein an absolute value of a difference between the first-relative orientation in the first X-Y plane and the second-relative orientation in the second X-Y plane is ninety degrees; and propagating the linearly-polarized-broadband-RF signal through the first X-Y plane and the second X-Y plane.

Example 11 includes the method of Example 10, further comprising: arranging a third-array of first-frequency slots having the first pass-band for the first frequency in a third metallic sheet in a third X-Y plane, the third X-Y plane between the first X-Y plane and the second X-Y plane; arranging a third-array of second-frequency slots having the second pass-band for the second frequency in the third metallic sheet in the third X-Y plane, the third-array of the first-frequency slots and the third-array of second frequency slots having a third-relative orientation in the third X-Y plane, wherein an absolute value of a difference between the first-relative orientation in the first X-Y plane and the third-relative orientation in the third X-Y plane is a selected angle; and propagating the linearly-polarized-broadband-RF signal through the first X-Y plane, the third X-Y plane, and the second X-Y plane.

Example 12 includes the method of Example 11, wherein arranging the first-array of the first-frequency slots in the first metallic sheet in the first X-Y plane and arranging the first-array of the second-frequency slots in the first metallic sheet in the first X-Y plane comprises etching the first-array of the first-frequency slots and the first-array of the second-frequency slots in a copper layer cladding a dielectric.

Example 13 includes the method of any of Examples 11-12, wherein arranging the second-array of the first-frequency slots in the second metallic sheet in the second X-Y plane and arranging the second-array of the second-frequency slots in the second metallic sheet in the second X-Y plane comprises etching the second-array of the first-frequency slots and the second-array of the second-frequency slots in a copper layer cladding a dielectric.

Example 14 includes the method of any of Examples 11-13, wherein arranging the third-array of the first-frequency slots in the third metallic sheet in the third X-Y plane and arranging the third-array of the second-frequency slots in the third metallic sheet in the third X-Y plane comprises etching the third-array of the first-frequency slots and the third-array of the second-frequency slots in a copper layer cladding a dielectric.

Example 15 includes the method of any of Examples 10-14, wherein arranging the first-array of the first-frequency slots in the first metallic sheet in the first X-Y plane and arranging the first-array of the second-frequency slots in the first metallic sheet in the first X-Y plane comprises etching the first-array of the first-frequency slots and the first-array of the second-frequency slots in a copper layer cladding a dielectric.

Example 16 includes the method of any of Examples 10-15, wherein arranging the second-array of the first-frequency slots in the second metallic sheet in the second X-Y plane and arranging the second-array of the second-frequency slots in the second metallic sheet in the second X-Y plane comprises etching the second-array of the first-frequency slots and the second-array of the second-frequency slots in a copper layer cladding a dielectric.

Example 17 includes a wideband frequency selective polarizer, comprising: a metallic first-slot sheet in a first X-Y plane, the first-slot sheet including: a first-array of first-frequency slots having a first pass-band for a first frequency, and a first-array of second-frequency slots having a second pass-band for a second frequency, the first-array of the first-frequency slots and the first-array of the second-frequency slots having a parallel orientation to each other in the first X-Y plane; and a metallic second-slot sheet in the second X-Y plane, the second X-Y plane offset from the first X-Y plane along a z direction by a first offset, the second-slot sheet including: a second-array of first-frequency slots having the first pass-band for the first frequency; and a second-array of second-frequency slots having the second pass-band for the second frequency, the second-array of the first-frequency slots and the second-array of second frequency slots having an angular orientation of Example 22.5 degrees to each other in the second X-Y plane, a metallic third-slot sheet in a third X-Y plane, the third X-Y plane offset from the second X-Y plane along a z direction by a second offset, the third-slot sheet including: a third-array of first-frequency slots having the first pass-band for the first frequency; and a third-array of second-frequency slots having the second pass-band for the second frequency, the third-array of the first-frequency slots and the third-array of second frequency slots having an orthogonal orientation to each other, wherein a polarization of a first-frequency radio frequency (RF) signal in an RF signal propagating through the first-slot sheet, the second-slot sheet, and the third-slot sheet is rotated by 45 degrees in a negative direction and a polarization of a second-frequency-RF signal in the RF signal propagating through the first-slot sheet, the second-slot sheet, and the third-slot sheet is rotated by 45 degrees in a positive direction.

Example 18 includes the wideband frequency selective polarizer of Example 17, wherein the first-slot sheet, the second-slot sheet, and the third-slot sheet are copper-clad dielectric sheets.

Example 19 includes the wideband frequency selective polarizer of any of Examples 17-18, wherein first-frequency slots have an I-beam shape.

Example 20 includes the wideband frequency selective polarizer of any of Examples 17-19, wherein the second-frequency slots have a rectangular shape.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A wideband frequency selective polarizer, comprising:

a first metallic sheet in a first plane including a first-array of first-frequency slots interspersed with a first-array of second-frequency slots, wherein the first-array of the first-frequency slots and the first-array of the second-frequency slots have a first-relative orientation; and a second metallic sheet in a second plane including a second-array of first-frequency slots interspersed with a second-array of second-frequency slots, wherein the second-array of the first-frequency slots and the second-array of second frequency slots have a second-relative orientation, the arrays of the first-frequency slots and the arrays of the second-frequency slots being arranged to one of:

rotate, by a first angle in a negative direction, a polarization of a first-frequency radio frequency (RF)

signal in a linearly-polarized-broadband-RF signal that propagates through the at least two planes; or leave the polarization of the first-frequency radio frequency (RF) signal in the linearly-polarized-broadband-RF signal that propagates through the at least two planes un-rotated; and wherein the arrays of the first-frequency slots and the arrays of the second-frequency slots are further arranged to rotate a polarization of a second-frequency-RF signal in the linearly-polarized-broadband-RF signal by a second angle in a positive direction.

2. The wideband frequency selective polarizer of claim 1, wherein the arrays of the first-frequency slots and the arrays of the second-frequency slots are arranged to rotate the polarization of the first-frequency radio frequency (RF) signal by the first angle, wherein the first angle and the second angle are forty-five degrees, wherein the first-frequency RF signal transmitted through the at least two planes is polarized orthogonally to the second-frequency-RF signal transmitted through the at least two planes.

3. The wideband frequency selective polarizer of claim 1, wherein the first plane is a first X-Y plane and the second plane is a second X-Y plane, and wherein the first-array of the first-frequency slots has a first pass-band for the first-frequency RF signal, and the first-array of the second-frequency slots has a second pass-band for the second-frequency RF signal, wherein the first-relative orientation is zero degrees and the second-relative orientation is ninety-degrees.

4. The wideband frequency selective polarizer of claim 3, wherein an offset-region in the space between the first metallic sheet and the second metallic sheet is at least partially filled with a dielectric material.

5. The wideband frequency selective polarizer of claim 1, wherein the first plane is a first X-Y plane and the second plane is a second X-Y plane, further wherein the second X-Y plane is offset from the first X-Y plane along a z direction by a first offset, wherein the wideband frequency selective polarizer further comprises:

a third metallic sheet in a third X-Y plane, wherein the third X-Y plane is offset from the second X-Y plane along the z direction by a second offset, the third metallic sheet including:

a third-array of the first-frequency slots having a first pass-band for the first-frequency RF signal; and a third-array of the second-frequency slots having the second pass-band for the second-frequency RF signal, the third-array of the first-frequency slots and the third-array of second frequency slots having a third-relative orientation in the third X-Y plane.

6. The wideband frequency selective polarizer of claim 5, wherein the first offset between the second metallic sheet and the first metallic sheet and the second offset between the third metallic sheet and the second metallic sheet are equal to about a quarter-wavelength of an average of a first wavelength and a second wavelength.

7. The wideband frequency selective polarizer of claim 5, wherein the first-array of the first-frequency slots in the first X-Y plane is orientated parallel to the second-array of the first-frequency slots in the second X-Y plane, and wherein the first-array of the first-frequency slots in the first X-Y plane is orientated parallel to the third-array of the first-frequency slots in the third X-Y plane.

8. The wideband frequency selective polarizer of claim 7, wherein a first-relative orientation of the first-array of the first-frequency slots and the first-array of the second-frequency slots in the first X-Y plane is parallel, and wherein the second-relative orientation of the second-array of the first-frequency slots and the second-array of the second-frequency slots in the second X-Y plane is 45 degrees, wherein the third-relative orientation of the third-array of the first-frequency slots and the third-array of second frequency slots in the third X-Y plane is 90 degrees, wherein the polarization of the first-frequency RF signal is un-rotated, and wherein the polarization of the second-frequency RF signal is rotated by 90 degrees.

9. A method of rotating an electric-field of a first-frequency radio frequency (RF) signal in a linearly-polarized-broadband-RF signal and an electric-field of a second-frequency-RF signal in the linearly-polarized-broadband-RF signal to be orthogonal to each other, the method comprising:

arranging a first-array of first-frequency slots having a first pass-band for the first frequency in a first metallic sheet in a first X-Y plane;

arranging a first-array of second-frequency slots having a second pass-band for the second frequency in the first metallic sheet in the first X-Y plane, wherein the first-array of first-frequency slots and the first-array of the second-frequency slots are interspersed with a first-relative orientation in the first X-Y plane;

arranging a second-array of first-frequency slots having the first pass-band for the first frequency in a second metallic sheet in a second X-Y plane;

arranging a second-array of second-frequency slots having the second pass-band for the second frequency in the second metallic sheet in the second X-Y plane, wherein the second-array of the first-frequency slots and the second-array of second frequency slots are interspersed with a second-relative orientation in the second X-Y plane, and wherein an absolute value of a difference between the first-relative orientation in the first X-Y plane and the second-relative orientation in the second X-Y plane is ninety degrees; and propagating the linearly-polarized-broadband-RF signal through the first X-Y plane and the second X-Y plane.

10. The method of claim 9, further comprising:

arranging a third-array of first-frequency slots having the first pass-band for the first frequency in a third metallic sheet in a third X-Y plane, the third X-Y plane between the first X-Y plane and the second X-Y plane;

arranging a third-array of second-frequency slots having the second pass-band for the second frequency in the third metallic sheet in the third X-Y plane, the third-array of the first-frequency slots and the third-array of second frequency slots having a third-relative orientation in the third X-Y plane, wherein an absolute value of a difference between the first-relative orientation in the first X-Y plane and the third-relative orientation in the third X-Y plane is a selected angle; and propagating the linearly-polarized-broadband-RF signal through the first X-Y plane, the third X-Y plane, and the second X-Y plane.

11. The method of claim 10, wherein arranging the first-array of the first-frequency slots in the first metallic sheet in the first X-Y plane and arranging the first-array of the second-frequency slots in the first metallic sheet in the first X-Y plane comprises etching the first-array of the first-frequency slots and the first-array of the second-frequency slots in a copper layer cladding a dielectric.

12. The method of claim 10, wherein arranging the second-array of the first-frequency slots in the second metallic sheet in the second X-Y plane and arranging the second-array of the second-frequency slots in the second metallic sheet in the second X-Y plane comprises etching the second-array of the first-frequency slots and the second-array of the second-frequency slots in a copper layer cladding a dielectric.

13. The method of claim 10, wherein arranging the third-array of the first-frequency slots in the third metallic sheet in the third X-Y plane and arranging the third-array of the second-frequency slots in the third metallic sheet in the third X-Y plane comprises etching the third-array of the first-frequency slots and the third-array of the second-frequency slots in a copper layer cladding a dielectric.

14. The method of claim 9, wherein arranging the first-array of the first-frequency slots in the first metallic sheet in the first X-Y plane and arranging the first-array of the second-frequency slots in the first metallic sheet in the first X-Y plane comprises etching the first-array of the first-frequency slots and the first-array of the second-frequency slots in a copper layer cladding a dielectric.

15. The method of claim 9, wherein arranging the second-array of the first-frequency slots in the second metallic sheet in the second X-Y plane and arranging the second-array of the second-frequency slots in the second metallic sheet in the second X-Y plane comprises etching the second-array of the first-frequency slots and the second-array of the second-frequency slots in a copper layer cladding a dielectric.

16. A wideband frequency selective polarizer, comprising:

a metallic first-slot sheet in a first X-Y plane, the first-slot sheet including:

a first-array of first-frequency slots having a first pass-band for a first frequency, and a first-array of second-frequency slots having a second pass-band for a second frequency, the first-array of the first-frequency slots and the first-array of the second-frequency slots having a parallel orientation to each other in the first X-Y plane; and a metallic second-slot sheet in a second X-Y plane, the second X-Y plane offset from the first X-Y plane along a z direction by a first offset, the second-slot sheet including:

a second-array of first-frequency slots having the first pass-band for the first frequency; and a second-array of second-frequency slots having the second pass-band for the second frequency, the second-array of the first-frequency slots and the second-array of second frequency slots having an angular orientation of 22.5 degrees to each other in the second X-Y plane, a metallic third-slot sheet in a third X-Y plane, the third X-Y plane offset from the second X-Y plane along a z direction by a second offset, the third-slot sheet including:

a third-array of first-frequency slots having the first pass-band for the first frequency; and a third-array of second-frequency slots having the second pass-band for the second frequency, the third-array of the first-frequency slots and the third-array of second frequency slots having an orthogonal orientation to each other, wherein a polarization of a first-frequency radio frequency (RF) signal in an RF signal propagating through the first-slot sheet, the second-slot sheet, and the third-slot sheet is rotated by 45 degrees in a negative direction and a polarization of a second-frequency-RF signal in the RF signal propagating through the first-slot sheet, the second-slot sheet, and the third-slot sheet is rotated by 45 degrees in a positive direction.

17. The wideband frequency selective polarizer of claim 16, wherein the first-slot sheet, the second-slot sheet, and the third-slot sheet are copper-clad dielectric sheets.

18. The wideband frequency selective polarizer of claim 16, wherein first-frequency slots have an I-beam shape.

19. The wideband frequency selective polarizer of claim 16, wherein the second-frequency slots have a rectangular shape.

* * * * *